US009213251B2

(12) United States Patent
Ohmori et al.

(10) Patent No.: US 9,213,251 B2
(45) Date of Patent: Dec. 15, 2015

(54) MAGNETIC TONER

(71) Applicant: CANON KABUSHIKI KAISHA, Tokyo (JP)

(72) Inventors: Atsuhiko Ohmori, Suntou-gun (JP); Michihisa Magome, Mishima (JP); Yusuke Hasegawa, Suntou-gun (JP); Keisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/364,633

(22) PCT Filed: Jan. 31, 2013

(86) PCT No.: PCT/JP2013/052787

§ 371 (c)(1),
(2) Date: Jun. 11, 2014

(87) PCT Pub. No.: WO2013/115413

PCT Pub. Date: Aug. 8, 2013

(65) Prior Publication Data

US 2014/0342277 A1 Nov. 20, 2014

(30) Foreign Application Priority Data

Feb. 1, 2012 (JP) ..... 2012-019517

(51) Int. Cl.
*G03G 9/087* (2006.01)
*G03G 9/083* (2006.01)
(Continued)

(52) U.S. Cl.
CPC ..... *G03G 9/0832* (2013.01); *G03G 9/0821* (2013.01); *G03G 9/0825* (2013.01);
(Continued)

(58) Field of Classification Search
CPC ..... G03G 9/0833; G03G 9/08708; G03G 9/0806; G03G 9/08711; G03G 9/09725; G03G 9/08795; G03G 9/08797; G03G 9/09708; G03G 9/08782
See application file for complete search history.

(56) References Cited

U.S. PATENT DOCUMENTS 6,485,876 B1 11/2002 Takezawa et al.
7,855,042 B2 12/2010 Kobori et al.
2010/0239971 A1* 9/2010 Moriya et al. ..... 430/108.6

FOREIGN PATENT DOCUMENTS

JP 08-012478 * 1/1996 ..... C05G 1/00
JP 8-328291 A 12/1996
(Continued)

OTHER PUBLICATIONS

Translation of JP 08-012478 published Jan. 1996.*
(Continued)

*Primary Examiner* — Peter Vajda
(74) *Attorney, Agent, or Firm* — Fitzpatrick, Cella, Harper and Scinto

(57) ABSTRACT

The magnetic toner contains: magnetic toner particles containing a binder resin and a magnetic body; and inorganic fine particles present on the surface of the magnetic toner particles, wherein the inorganic fine particles present on the surface of the magnetic toner particles comprise strontium titanate fine particles and metal oxide fine particles, and the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles. In addition, the magnetic toner has a characteristic state of coverage, by the inorganic fine particles, of the magnetic toner particle surface, and the ratio [D4/D1] of the weight-average particle diameter (D4) to the number-average particle diameter (D1) is in a prescribed range.

4 Claims, 7 Drawing Sheets

(51) Int. Cl.
*G03G 9/08* (2006.01)
*G03G 9/097* (2006.01)

(52) U.S. Cl.
CPC ..... *G03G9/0827* (2013.01); *G03G 9/0833* (2013.01); *G03G 9/0836* (2013.01); *G03G 9/0839* (2013.01); *G03G 9/09708* (2013.01); *G03G 9/09725* (2013.01)

(56) References Cited

FOREIGN PATENT DOCUMENTS

| | | | |
|---|---|---|---|
| JP | 2001-117267 | A | 4/2001 |
| JP | 2005-234257 | A | 9/2005 |
| JP | 2006-71850 | A | 3/2006 |
| JP | 2006-154060 | A | 6/2006 |
| JP | 3812890 | B2 | 8/2006 |
| JP | 2007-183339 | A | 7/2007 |
| JP | 2007-293043 | A | 11/2007 |
| JP | 2008-15248 | A | 1/2008 |
| JP | 4799567 | B2 | 10/2011 |

OTHER PUBLICATIONS

Hasegawa, et al., U.S. Appl. No. 14/364,067, filed Jun. 9, 2014.
Magome, et al., U.S. Appl. No. 14/364,068, filed Jun. 9, 2014.
Hiroko, et al., U.S. Appl. No. 14/364,065, filed Jun. 9, 2014.
Suzumura, et al., U.S. Appl. No. 14/362,380, filed Jun. 2, 2014.
Matsui, et al., U.S. Appl. No. 14/362,377, filed Jun. 2, 2014.
Sano, et al., U.S. Appl. No. 14/364,636, filed Jun. 11, 2014.
Uratani, et al., U.S. Appl. No. 14/364,634, filed Jun. 11, 2014.
Nomura, et al., U.S. Appl. No. 14/364,640, filed Jun. 11, 2014.
Tanaka, et al., U.S. Appl. No. 14/364,638, filed Jun. 11, 2014.
PCT International Search Report and Written Opinion of the International Searching Authority, International Application No. JP2013/052787, Mailing Date Apr. 9, 2013.
Taiwanese Office Action dated Mar. 19, 2015 in Taiwanese Application No. 102104005.

* cited by examiner

MAGNETIC TONER

TECHNICAL FIELD

The present invention relates to a magnetic toner for use in, for example, electrophotographic methods, electrostatic recording methods, and magnetic recording methods.

BACKGROUND ART

Numerous methods are known for the practice of electrophotography. At a general level, these are methods in which a copied article is obtained by an image-forming procedure having a charging step in which an electrostatic latent image-bearing member is charged; an electrostatic latent image-forming step in which an electrostatic latent image is formed on the charged electrostatic latent image-bearing member; a step in which the electrostatic latent image is developed by magnetic toner carried on a magnetic toner-carrying member in order to form a magnetic toner image on the electrostatic latent image-bearing member; a transfer step in which this toner image on the electrostatic latent image-bearing member is transferred to a transfer material; a fixing step in which this toner image is fixed on the recording medium by, for example, the application of heat or pressure; and a cleaning step in which the magnetic toner on the electrostatic latent image-bearing member is removed by a cleaning blade. Copiers and printers are examples of such image-forming apparatuses.

Image-forming apparatuses, e.g., copiers and printers, have in recent years been experiencing increasing diversification in their intended applications and use environments as well as demand for additional improvements in speed, image quality, and stability. For example, printers, which previously were used mainly in office environments, have also entered into use in severe environments, and the generation of stable images even under these circumstances has become critical.

Copiers and printers are also undergoing device downsizing and enhancements in energy efficiency, and magnetic monocomponent development systems that use a favorable magnetic toner are preferably used in this context.

In a magnetic monocomponent development system, development is carried out by transporting a magnetic toner into the development zone using a toner-carrying member (referred to below as a developing sleeve) that incorporates in its interior means of generating a magnetic field, e.g., a magnet roll. In addition, charge is imparted to the magnetic toner mainly by triboelectric charging brought about by rubbing between the magnetic toner and a triboelectric charge-providing member, for example, the developing sleeve. Reducing the size of the developing sleeve is an important technology in particular from the standpoint of reducing the size of the device.

When, for example, the coverage of the magnetic toner by an external additive is inadequate or the magnetic toner is used in a severe environment, e.g., a high-temperature, high-humidity environment (in the following, a severe environment refers to conditions of 40° C. and 95% RH), its triboelectric charging may not proceed uniformly and charging of the magnetic toner may then become nonuniform.

As a result, a phenomenon can occur in which only a portion of the magnetic toner is excessively charged, so-called charge-up, and various image defects may then occur.

In particular, when the developing sleeve has been downsized as referenced above, the development zone of the development nip region is narrowed and the flight of the magnetic toner from the developing sleeve is made more difficult. As a consequence, a portion of the magnetic toner is prone to remain on the developing sleeve and a trend of greater charging instability sets in.

For example, a reduction in image density can occur when charged-up toner remains on the developing sleeve, while an image defect such as fogging in the nonimage areas can be caused when the toner charge is nonuniform. Furthermore, when used after standing for a while in a severe environment, the aggregative behavior exhibited by the toner is increased due to the pressure on the toner in the developer container. In addition, a phenomenon has occurred in which only a portion of the magnetic toner on the developing sleeve undergoes excessive charging and a reduced-density phenomenon has been produced.

In response to these problems, numerous techniques have been proposed in which stabilization of the changes in developing performance and transfer performance that accompany environmental variations is brought about by the addition of strontium titanate—as an external additive that imparts abrasiveness to the magnetic toner in order to prevent residence of the toner at the developing sleeve and as an agent that relaxes the charging performance during development and transfer in order to inhibit charge up.

For example, in Patent Document 1, the attempt is made to lower the variation in charging performance that accompanies environmental variations: this is done through the addition of a complex oxide composed of strontium titanate, strontium carbonate, or titanic acid because this can impart abrasiveness to the magnetic toner.

A certain effect on image problems such as, e.g., charging roller contamination due to faulty cleaning, is in fact obtained under certain prescribed conditions. However, the flowability and aggregative behavior immediately after standing in a severe environment of higher temperature and higher humidity are in particular not adequately addressed, and there is still room for improvement with regard to the reduced initial density after standing in a severe environment. There is room for improvement with these problems in particular when a small-diameter developing sleeve is installed since aggregation of the magnetic toner on the developing sleeve causes the developing performance to deteriorate.

In Patent Document 2, a toner is disclosed for which charge up is inhibited through a lowering of the number of times of toner-to-toner contact; this is achieved by the addition of a strontium titanate whose volumetric particle diameter distribution has a shoulder on the large particle diameter side at 300 nm or above.

This control of the strontium titanate particle diameter does in fact provide a certain effect on the developing characteristics, e.g., sleeve ghosting due to charging defects, under certain prescribed conditions. However, the problem of charge up produced due to the detachment of large-diameter strontium titanate particles is not adequately addressed, and there is room for improvement with these problems in particular when a small-diameter developing sleeve is installed since the developing zone is then narrow and the charged-up toner undergoes development with difficulty.

On the other hand, in order to solve the problems associated with external additives, toners have been disclosed with a particular focus on the release of external additives (refer to Patent Documents 3 and 4). The charging stability of magnetic toners is again not adequately addressed in these cases.

Moreover, Patent Document 5 teaches stabilization of the development•transfer steps by controlling the total coverage ratio of the toner base particles by the external additives, and a certain effect is in fact obtained by controlling the theoretical coverage ratio, provided by calculation, for a certain prescribed toner base particle. However, the actual state of binding by external additives may be substantially different from the value calculated assuming the toner to be a sphere, and, for magnetic toners in particular, achieving the effects of the present invention without controlling the actual state of external additive binding has proven to be entirely unsatisfactory.

CITATION LIST

Patent Literature

[PTL 1] Japanese Patent Application Publication No. 2007-553008

[PTL 2] Japanese Patent Application Publication No. 2005-234257

[PTL 3] Japanese Patent Application Publication No. 2001-117267

[PTL 4] Japanese Patent Publication No. 3,812,890

[PTL 5] Japanese Patent Application Publication No. 2007-293043

SUMMARY OF INVENTION

Technical Problems

An object of the present invention is to provide a magnetic toner that can solve the problems identified above.

Specifically, an object of the present invention is to provide a magnetic toner that can prevent fogging and density reduction from occurring in the initial image immediately after standing in a severe environment.

Solution to Problem

The present inventors discovered that the problems identified above can be solved for the first time by specifying a relationship between the coverage ratio of the magnetic toner particle surface by the inorganic fine particles and the coverage ratio by inorganic fine particles that are fixed to the magnetic toner particle surface, by setting the content of the strontium titanate fine particles relative to the magnetic toner, by specifying the particle diameter of the strontium titanate fine particles and the release rate of the strontium titanate fine particles in a magnetic field, and by controlling the particle diameter distribution of the magnetic toner. The present invention was achieved based on this discovery.

Thus, the present invention is described as follows:

a magnetic toner comprising: magnetic toner particles comprising a binder resin and a magnetic body; and inorganic fine particles present on the surface of the magnetic toner particles, wherein the inorganic fine particles present on the surface of the magnetic toner particles comprise strontium titanate fine particles and metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85, the content of the strontium titanate fine particles, expressed with reference to the total amount of the magnetic toner, is from at least 0.1 mass % to not more than 3.0 mass %, the number-average particle diameter (D1) of the strontium titanate fine particles is from at least 60 nm to not more than 300 nm, in a magnetic separation test during the application of a negative voltage, the release rate for the strontium titanate fine particles is at least 10%, and the ratio [D4/D1] of the weight-average particle diameter (D4) to the number-average particle diameter (D1) for the magnetic toner is not more than 1.30.

Advantageous Effects of Invention

The present invention can provide a magnetic toner that can prevent fogging and density reduction from occurring in the initial image after standing in a severe environment.

DESCRIPTION OF EMBODIMENTS

Figure 1:
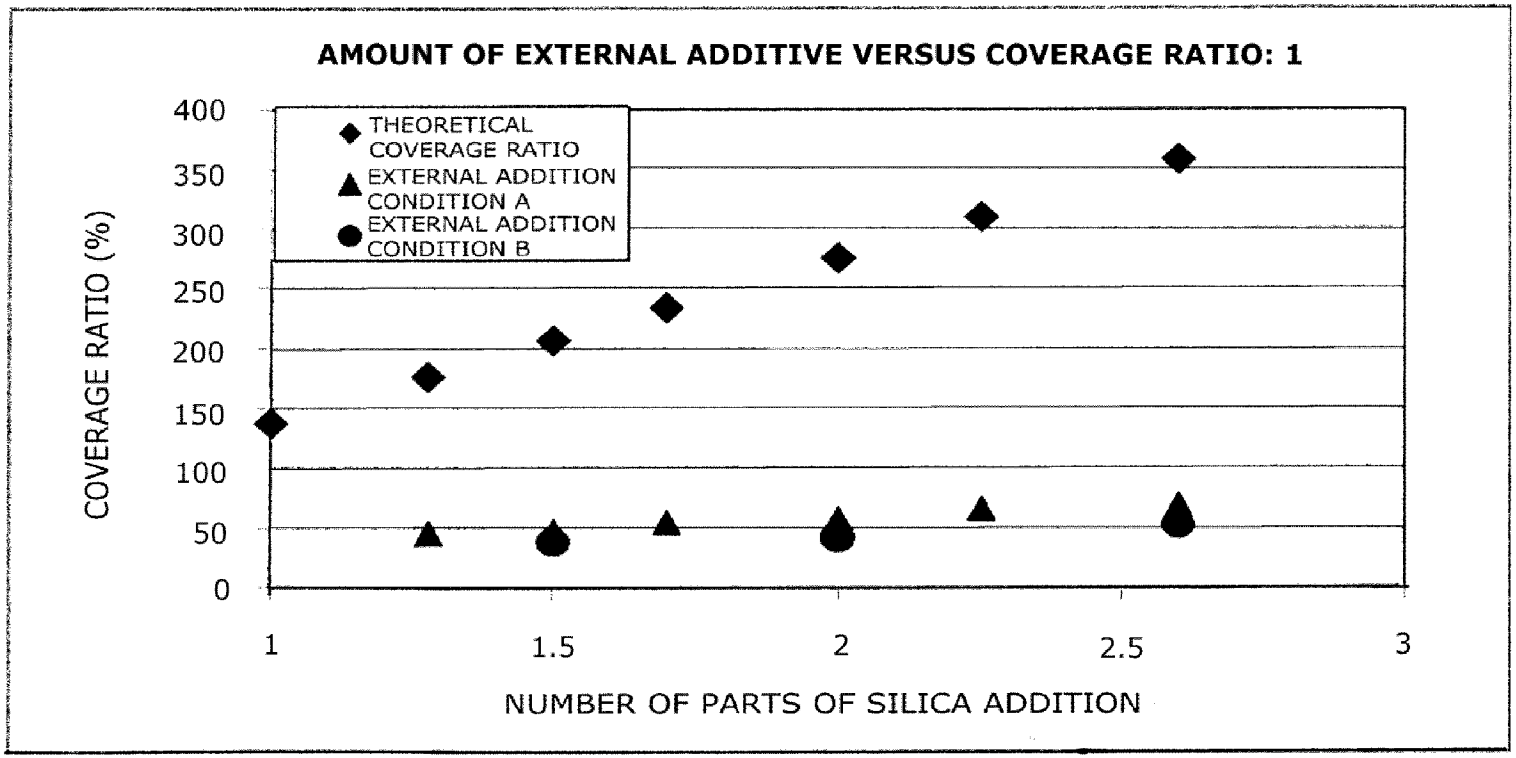
FIG. 1 is a diagram that shows an example of the relationship between the number of parts of silica addition and the coverage ratio.

The present invention is described in detail below.

The magnetic toner of the present invention is a magnetic toner comprising magnetic toner particles containing a binder resin and a magnetic body, and inorganic fine particles present on the surface of the magnetic toner particles, wherein the inorganic fine particles present on the surface of the magnetic toner particles comprise strontium titanate fine particles and metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85, the content of the strontium titanate fine particles, expressed with reference to the total amount of the magnetic toner, is from at least 0.1 mass % to not more than 3.0 mass %, the number-average particle diameter (D1) of the strontium titanate fine particles is from at least 60 nm to not more than 300 nm, in a magnetic separation test during the application of a negative voltage, the release rate for the strontium titanate fine particles is at least 10%, and the ratio [D4/D1] of the weight-average particle diameter (D4) to the number-average particle diameter (D1) for the magnetic toner is not more than 1.30.

According to investigations by the present inventors, the use of the above-described magnetic toner can prevent fogging and density reduction from occurring even for the initial image after standing in a severe environment.

Here, the occurrence of fogging and density reduction in the initial image after standing in a severe environment is hypothesized to have the following causes.

Due to the humidity and temperature, aggregates are readily produced in the magnetic toner during standing in a severe environment. As a consequence of this, the flowability of the magnetic toner on the developing sleeve and within the developer container ends up declining. When printing is carried out in this state, the magnetic toner aggregates engage in development with difficulty and as a result are rubbed many times in the nip region between the developing sleeve and the developing blade. The aggregates on the developing sleeve which have been charged up by the rubbing are resistant to engaging in development, which causes a reduction in the density to occur. In addition, when the charging characteristics on the developing sleeve become nonuniform due to the reduced flowability on the developing sleeve and within the developer container, variation is produced in the spikes that rise to the electrostatic latent image-bearing member, which again causes a reduction in the density to occur.

Furthermore, the aggregated fine particles produced due to the reduced flowability within the developer container readily fly over to nonimage areas, and fogging is then prone to occur as a result.

That is, when the flowability of the magnetic toner within the developer container and at the developing sleeve is reduced, a large variation occurs in the nap and in the charging performance on the developing sleeve, and as a consequence fogging and density reduction are readily produced in the initial image after standing in a severe environment.

Moreover, when a small-diameter developing sleeve is used in order to reduce the size of the machine, the developing sleeve exhibits a large curvature and the developing zone in the development nip region is then narrow, which impairs the flight of the magnetic toner from the developing sleeve to the electrostatic latent image-bearing member and thereby facilitates a decline in the density.

Thus, enhancing the flowability of the magnetic toner and suppressing variation in the charging performance of the magnetic toner that flies to the electrostatic latent image-bearing member are effective for inhibiting the density reduction in the initial image after standing in a severe environment. Numerous proposals have already been made with regard to a technology for enhancing the flowability and a technology for reducing the variation in the charging performance on the developing sleeve; however, these technologies have been inadequate with regard to inhibiting the density reduction in the initial image after standing in a severe environment. It has not been possible to obtain a satisfactory inhibition of the density reduction and fogging in particular when image output has been carried out using a machine equipped with a small-diameter developing sleeve after standing in a severe environment.

As a result of their investigations, the present inventors found that the flowability of the magnetic toner can be enhanced by bringing a magnetic toner with a narrow particle diameter distribution into a special state of external addition and that separation charging by the strontium titanate fine particles when the magnetic toner flies to the electrostatic latent image-bearing member can be promoted by a judicious external addition of the strontium titanate fine particles. The result was the discovery that the bias-following behavior of the magnetic toner could be enhanced and the density reduction in the initial image after standing in a severe environment could be inhibited.

It is crucial for the magnetic toner of the present invention that (1) strontium titanate fine particles are present on the surface of the magnetic toner particles and the content of these strontium titanate fine particles, expressed with reference to the total amount of the magnetic toner, is from at least 0.1 mass % to not more than 3.0 mass %;

(2) the number-average particle diameter (D1) of the strontium titanate fine particles is from at least 60 nm to not more than 300 nm;

(3) in a magnetic separation test during the application of a negative voltage, the release rate for the strontium titanate fine particles is at least 10%; and (4) the ratio [D4/D1] of the weight-average particle diameter (D4) to the number-average particle diameter (D1) for the magnetic toner is not more than 1.30.

The authors believe that the strontium titanate fine particles can be controlled to the prescribed release behavior by adjustments based on, for example, the content of the strontium titanate fine particles and the state of attachment by the strontium titanate fine particles to the magnetic toner particles.

First, the attachment to the magnetic toner particles of the strontium titanate fine particles in the amount required for separation charging in the developing zone can be brought about by bringing the strontium titanate fine particle content, expressed with reference to the entire amount of the magnetic toner, to from at least 0.1 mass % to not more than 3.0 mass %. When the strontium titanate fine particle content is less than 0.1 mass %, separation charging in the developing zone is almost completely absent due to the small amount of strontium titanate fine particles. When, on the other hand, the strontium titanate fine particle content exceeds 3.0 mass %, separation charging occurs in the developer container due to the excess of strontium titanate fine particles attached to the magnetic toner.

Next, in a magnetic separation test during the application of a negative voltage, the release rate for the strontium titanate fine particles is at least 10% and preferably is from at least 15% to not more than 30%.

In order, in a magnetic separation test during the application of a negative voltage, to increase the release rate of strontium titanate fine particles that have a number-average particle diameter (D1) of from at least 60 nm to not more than 300 nm, it is also crucial that the strontium titanate fine particles be attached in a special state of external addition. That is, it is crucial that the strontium titanate fine particles be lightly attached in a loosened-up state to the magnetic toner particle surface on which there is present at least one type of metal oxide fine particle selected from the group consisting of silica fine particles, titania fine particles, and alumina fine particles. Strontium titanate fine particles with a small particle diameter are strongly aggregative. On the other hand, release from the magnetic toner by physical force is impeded when a loosened-up state exists. Due to this, when the strontium titanate fine particles are externally added to the magnetic toner particles using a weak force, aggregates of the strontium titanate fine particles undergo external addition without being loosened up. The aggregated strontium titanate fine particles are easily released by physical force and separation charging in the developer container then occurs. When, on the other hand, the strontium titanate fine particles are externally added to the magnetic toner particles using a strong force, the aggregates of the strontium titanate fine particles are loosened up, but embedding in the magnetic toner particle surface ends up occurring. Due to this, separation charging does not occur in the developing zone. Accordingly, the strontium titanate fine particles can be lightly attached in a loosened-up state to the magnetic toner particle surface by performing external addition of the strontium titanate fine particles using a strong force after the magnetic toner particle surface has been coated with, e.g., silica fine particles. By attaching the strontium titanate fine particles in a loosened-up state with a low degree of embedding of the strontium titanate fine particles, physical force-induced separation charging in the developer container does not occur, while electrical force-induced separation charging in the developing zone does occur.

When the strontium titanate fine particles have a large release rate in a magnetic separation test under the application of negative voltage, the strontium titanate fine particles also exhibit a large detachment rate in the developing zone. Thus, with a release rate in the magnetic separation test under the application of negative voltage being large and being in the range of the present invention, it is indicated that the strontium titanate fine particles will undergo detachment in the developing zone and separation charging will occur there. When this separation charging occurs, the magnetic toner takes flight in the developing zone in conformity with the latent image and a diminished image density can be prevented.

Moreover, letting the coverage ratio A (%) be the coverage ratio of the magnetic toner particle surface by the inorganic fine particles and letting the coverage ratio B (%) be the coverage ratio by the inorganic fine particles that are fixed to the magnetic toner particle surface, it is critical for the magnetic toner of the present invention that the coverage ratio A be at least 45.0% and not more than 70.0% and that the ratio [coverage ratio B/coverage ratio A, also referred to below simply as B/A] of the coverage ratio B to the coverage ratio A be at least 0.50 and not more than 0.85.

The coverage ratio A is preferably at least 45.0% and not more than 65.0% and B/A is preferably at least 0.55 and not more than 0.80.

Having the coverage ratio A and B/A satisfy the ranges indicated above makes it possible to substantially approach "cloud development", in which the individual toner particles undergo development discretely, from "spike development", in which the magnetic toner nap on the developing sleeve undergoes development as such.

The reason for this is hypothesized to be as follows.

In development using a magnetic toner, the magnetic toner transported by the developing sleeve comes into contact with the developing blade and the developing sleeve in the contact region between the developing blade and the developing sleeve and is charged by friction at this time. As a consequence, when magnetic toner remains on the developing sleeve without undergoing development, it is repeatedly subjected to friction and variation in the charging performance is ultimately produced.

However, since, with the magnetic toner of the present invention, the coverage ratio A of the magnetic toner particle surface by the inorganic fine particles has a high value of at least 45.0%, the van der Waals forces and electrostatic forces with the contact members are low and the ability of the magnetic toner to remain on the developing blade or in proximity to the developing sleeve is suppressed. The inorganic fine particles must be added in large amounts in order to bring the coverage ratio A above 70.0%, but, even if an external addition method could be devised here, image defects (vertical streaks) brought about by released inorganic fine particles are then readily produced and this is therefore disfavored.

This coverage ratio A, coverage ratio B, and ratio [B/A] of the coverage ratio B to the coverage ratio A can be determined by the methods described below.

The coverage ratio A used in the present invention is a coverage ratio that also includes the easily-releasable inorganic fine particles, while the coverage ratio B is the coverage ratio due to inorganic fine particles that are fixed to the magnetic toner particle surface and are not released in the release process described below. It is thought that the inorganic fine particles represented by the coverage ratio B are fixed in a semi-embedded state in the magnetic toner particle surface and therefore do not undergo displacement even when the magnetic toner is subjected to shear on the developing sleeve or on the electrostatic latent image-bearing member.

The inorganic fine particles represented by the coverage ratio A, on the other hand, include the fixed inorganic fine particles described above as well as inorganic fine particles that are present in the upper layer and have a relatively high degree of freedom.

As noted above, it is thought that the inorganic fine particles that can be present between magnetic toner particles and between the magnetic toner and the various members participate in bringing about the effect of diminished van der Waals forces and diminished electrostatic forces and that having a high coverage ratio A is particularly critical with regard to this effect.

First, the van der Waals force (F) produced between a flat plate and a particle is represented by the following equation.

$$F=H\times D/(12Z^2)$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the magnetic toner surface, the van der Waals force (F) is smaller for an inorganic fine particle, with its smaller particle size, in contact with the flat plate than for a magnetic toner particle in contact with the flat plate. That is, the van der Waals force is smaller for the case of contact through the intermediary of the inorganic fine particles provided as an external additive than for the case of direct contact between the magnetic toner particle and the developing sleeve or developing blade.

Furthermore, the electrostatic force can be regarded as a reflection force. It is known that a reflection force is directly proportional to the square of the particle charge (q) and is inversely proportional to the square of the distance.

In the case of the charging of a magnetic toner, it is the surface of the magnetic toner particle and not the inorganic fine particles that bear the charge. Due to this, the reflection force declines as the distance between the surface of the magnetic toner particle and the flat plate (here, the developing sleeve or developing blade) grows larger.

That is, when, in the case of the magnetic toner surface, the magnetic toner particle comes into contact with the flat plate through the intermediary of the inorganic fine particles, a distance is set up between the flat plate and the surface of the magnetic toner particle and the reflection force is lowered as a result.

As described in the preceding, the van der Waals force and reflection force produced between the magnetic toner and the developing sleeve or developing blade are reduced by having inorganic fine particles be present at the magnetic toner particle surface and having the magnetic toner come into contact with the developing sleeve or developing blade with the inorganic fine particles interposed therebetween. That is, the attachment force between the magnetic toner and the developing sleeve or developing blade is reduced.

Whether the magnetic toner particle directly contacts the developing sleeve or developing blade or is in contact therewith through the intermediary of the inorganic fine particles, depends on the amount of inorganic fine particles coating the magnetic toner particle surface, i.e., on the coverage ratio by the inorganic fine particles.

It is thought that the opportunity for direct contact between the magnetic toner particles and the developing sleeve or developing blade is diminished at a high coverage ratio by the inorganic fine particles, which makes it more difficult for the magnetic toner to stick to the developing sleeve or developing blade. On the other hand, the magnetic toner readily sticks to the developing sleeve or developing blade at a low coverage ratio by the inorganic fine particles and is prone to remain on the developing blade or in proximity to the developing sleeve.

With regard to the coverage ratio by the inorganic fine particles, a theoretical coverage ratio can be worked out on the assumption that the inorganic fine particles and the magnetic toner have a spherical shape—using the equation described, for example, in Patent Document 5. However, there are also many instances in which the inorganic fine particles and/or the magnetic toner do not have a spherical shape, and in addition the inorganic fine particles may also be present in an aggregated state at the toner particle surface. As a consequence, the theoretical coverage ratio derived using the indicated technique does not pertain to the present invention.

The present inventors therefore carried out observation of the magnetic toner surface with the scanning electron microscope (SEM) and determined the coverage ratio for the actual coverage of the magnetic toner particle surface by the inorganic fine particles.

Figure 2:
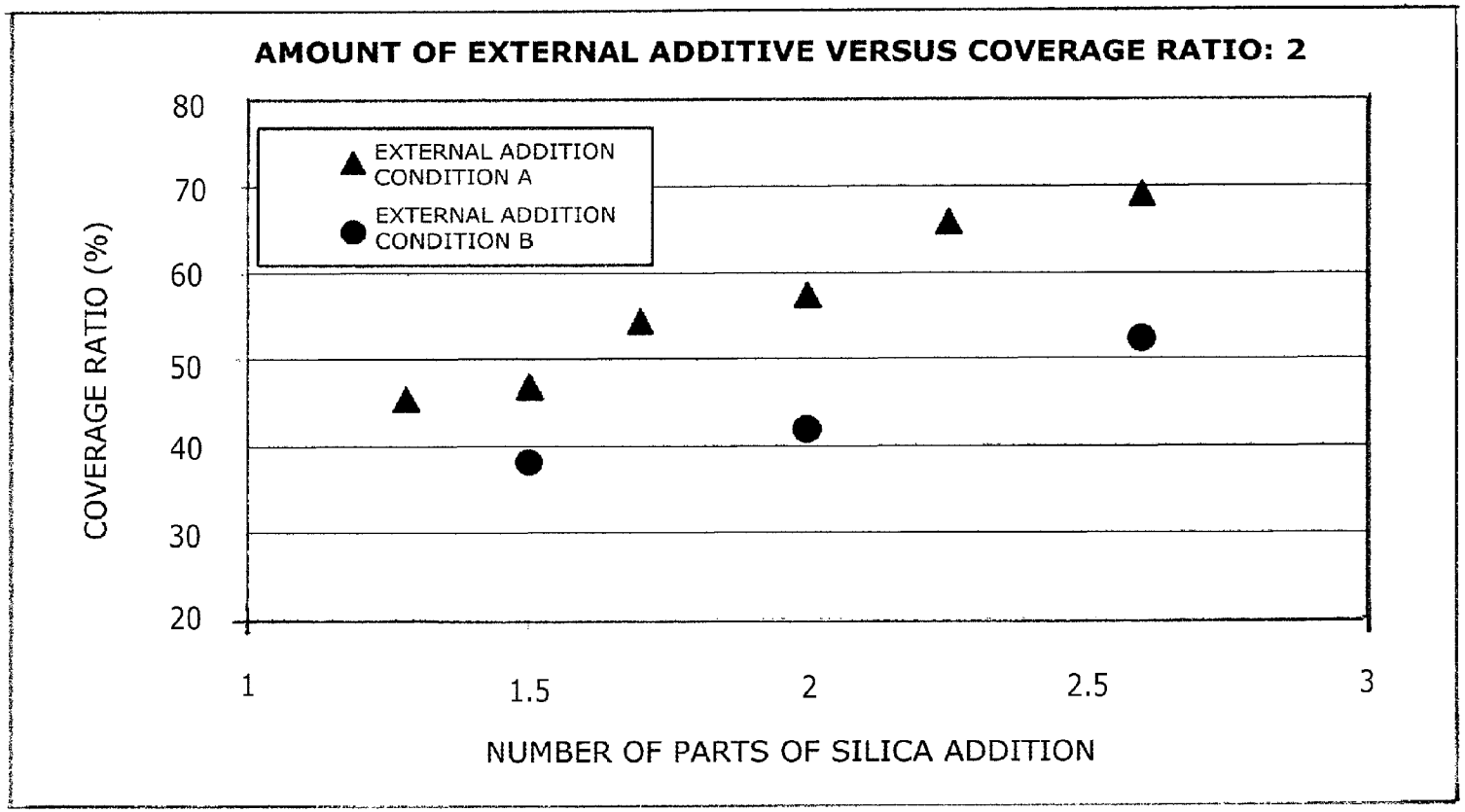
FIG. 2 is a diagram that shows an example of the relationship between the number of parts of silica addition and the coverage ratio.

As one example, the theoretical coverage ratio and the actual coverage ratio were determined for mixtures prepared by adding different amounts of silica fine particles (number of parts of silica addition to 100 mass parts of magnetic toner particles) to magnetic toner particles (magnetic body content=43.5 mass %) provided by a pulverization method and having a volume-average particle diameter (Dv) of 8.0 μm (refer to FIGS. 1 and 2). Silica fine particles with a volume-average particle diameter (Dv) of 15 nm were used for the silica fine particles. For the calculation of the theoretical coverage ratio, 2.2 g/cm$^3$ was used for the true specific gravity of the silica fine particles; 1.65 g/cm$^3$ was used for the true specific gravity of the magnetic toner; and monodisperse particles with a particle diameter of 15 nm and 8.0 μm were assumed for, respectively, the silica fine particles and the magnetic toner particles.

As shown in FIG. 1, the theoretical coverage ratio exceeds 100% as the amount of addition of the silica fine particles is increased. On the other hand, the actual coverage ratio does vary with the amount of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique. That is, it is not possible to determine the coverage ratio uniquely from the amount of addition of the inorganic fine particles (refer to FIG. 2). Here, external addition condition A refers to mixing at 1.0 W/g for a processing time of 5 minutes using the apparatus shown in FIG. 5. External addition condition B refers to mixing at 4000 rpm for a processing time of 2 minutes using an FM10C Henschel mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

In addition, as has been thus explained, it is thought that the attachment force to a member can be reduced by raising the coverage ratio by the inorganic fine particles. Tests were therefore carried out on the attachment force with a member and the coverage ratio by the inorganic fine particles.

The relationship between the coverage ratio for the magnetic toner and the attachment force with a member was indirectly inferred by measuring the static coefficient of friction between an aluminum substrate and spherical polystyrene particles having different coverage ratios by silica fine particles.

Specifically, the relationship between the coverage ratio and the static coefficient of friction was determined using spherical polystyrene particles (weight-average particle diameter (D4)=7.5 μm) that had different coverage ratios (coverage ratio determined by SEM observation) by silica fine particles.

Figure 3:
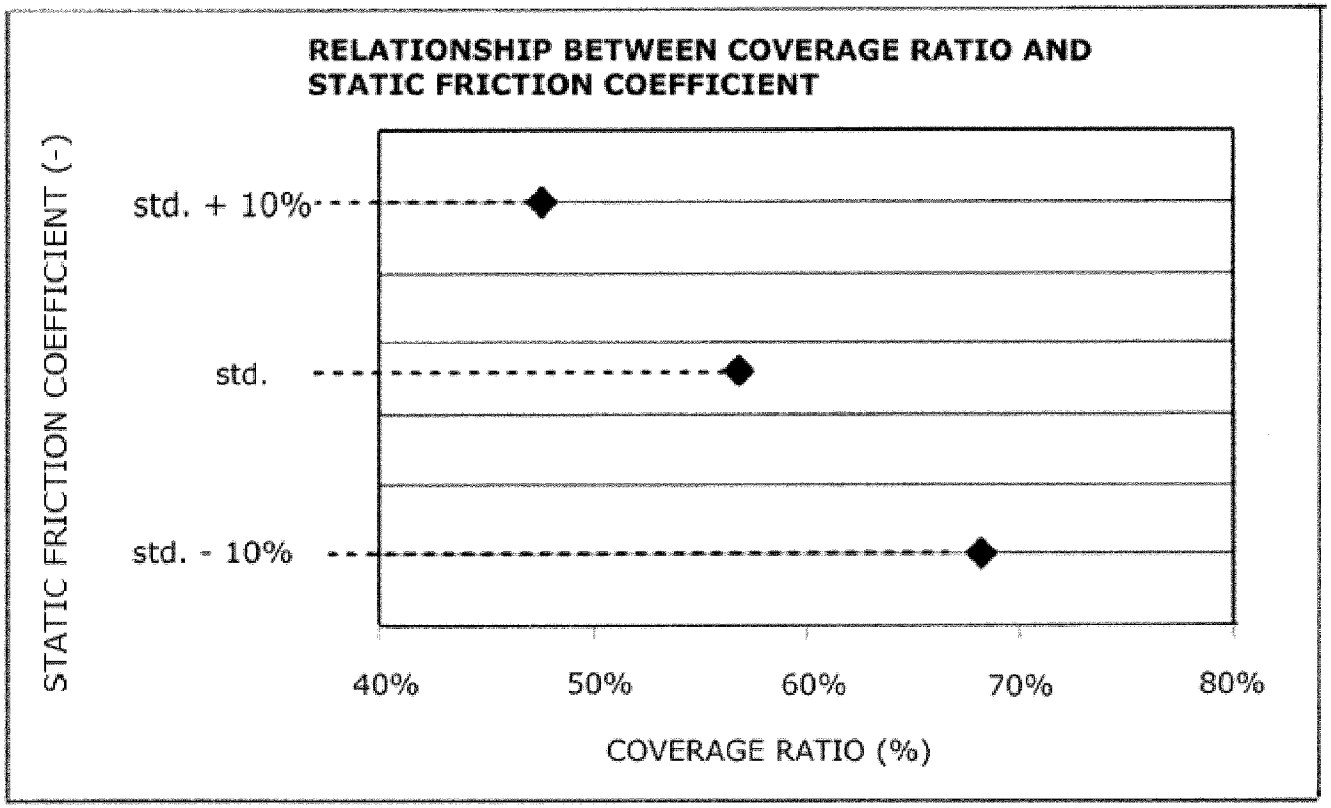
FIG. 3 is a diagram that shows an example of the relationship between the coverage ratio and the static friction coefficient.

More specifically, spherical polystyrene particles to which silica fine particles had been added were pressed onto an aluminum substrate. The substrate was moved to the left and right while changing the pressing pressure, and the static coefficient of friction was calculated from the resulting stress. This was performed for the spherical polystyrene particles at each different coverage ratio, and the obtained relationship between the coverage ratio and the static coefficient of friction is shown in FIG. 3.

The static coefficient of fraction determined by the preceding technique is thought to correlate with the sum of the van der Waals and reflection forces acting between the spherical polystyrene particles and the substrate. As may be understood from FIG. 3, a higher coverage ratio by the silica fine particles results in a lower static coefficient of friction. This suggests that a magnetic toner that presents a high coverage ratio by inorganic fine particles also has a low attachment force for members.

When the present inventors carried out intensive investigations based on these results, it was discovered that the flowability could be raised by controlling the coverage ratio by the inorganic fine particles. Moreover, as has been described above, inhibiting the production of charged-up toner is critical for suppressing the decline in image density.

As a result of investigations by the present inventors, it was found that, by having a high coverage ratio A, the flowability can be raised and the inhibition of the generation of charged-up toner can then be substantially enhanced. This is thought to be due to the following: even when a highly adherent toner that can attach to the developing blade is present to some degree, the attachment force between the magnetic toner and the developing blade is presumably brought down enough by the high coverage ratio A that the flowability of the magnetic toner as a whole is raised.

That B/A is at least 0.50 to not more than 0.85 means that inorganic fine particles fixed to the magnetic toner particle surface are present to a certain degree and that in addition inorganic fine particles in a readily releasable state (a state that enables behavior separated from the magnetic toner particle) are also present in a favorable amount. It is thought that a bearing-like effect is generated presumably by the releasable inorganic fine particles sliding against the fixed inorganic fine particles and that the aggregative forces between the magnetic toners are then substantially reduced.

According to the results of investigations by the present inventors, it was found that this bearing effect and the above-described attachment force-reducing effect are maximally obtained when both the fixed inorganic fine particles and the easily releasable inorganic fine particles are relatively small inorganic fine particles having a primary particle number-average particle diameter (D1) of approximately not more than 50 nm. Accordingly, the coverage ratio A and B were calculated focusing on the inorganic fine particles having a primary particle number-average particle diameter (D1) of not more than 50 nm.

By setting prescribed ranges for the coverage ratio A and B/A for the magnetic toner of the present invention, the attachment force between the magnetic toner and various members can be reduced and the aggregative forces between the magnetic toners can be substantially diminished. As a result, in the step of developing the electrostatic latent image with the magnetic toner, the magnetic toner particles individually disengage and fly over to the electrostatic latent image-bearing member and as a consequence cloud development is made possible for the first time in the case of the magnetic toner presenting the above-described external additive state. Cloud development can be easily produced and the reduction in flowability can be substantially diminished in particular when the developing sleeve is provided with a small diameter in pursuit of downsizing.

In the present invention, the coefficient of variation on the coverage ratio A is preferably not more than 10.0% and more preferably the coefficient of variation on the coverage ratio A is not more than 8.0%. The specification of a coefficient of variation on the coverage ratio A of not more than 10.0% means that the coverage ratio A is very uniform between magnetic toner particles and within magnetic toner particles. When the coefficient of variation exceeds 10.0%, the state of coverage of the magnetic toner surface is nonuniform, which impairs the ability to lower the aggregative forces between the magnetic toners.

There are no particular limitations on the technique for bringing the coefficient of variation to 10.0% or below, but the use is preferred of the external addition apparatus and technique described below, which are capable of bringing about a high degree of spreading of the metal oxide fine particles, e.g., silica fine particles, over the magnetic toner particle surfaces.

It is also crucial for the magnetic toner of the present invention that the ratio [D4/D1] of the weight-average particle diameter (D4) to the number-average particle diameter (D1) be not more than 1.30. Not more than 1.26 is preferred.

The "density reduction after standing in a severe environment" can be prevented for the first time by establishing a state of external addition in which the coverage ratio A, B/A, and the release rate of the strontium titanate fine particles satisfy prescribed ranges in magnetic toner particles having the sharp particle diameter distribution indicated above.

The authors hypothesize the following with regard to the reasons for this.

When a magnetic toner is allowed to stand under challenging conditions such as a severe environment, for example, the release agent and low molecular weight components in the binder resin gradually outmigrate from the interior of the magnetic toner, and this enhances the aggregative behavior of the magnetic toner at the developing sleeve and within the developer container. In the case of a magnetic toner that has a narrow particle diameter distribution, the magnetic toner contacts the developing sleeve and neighboring magnetic toner equally and the aggregates produced during standing in a severe atmosphere are then small. As a consequence, with the magnetic toner of the present invention, which has a particle diameter distribution controlled into the above-described range, the nap on the developing sleeve is both uniform and low even after standing in a severe atmosphere, which brings about cloud development in which the magnetic toner disengages and flies to the electrostatic latent image-bearing member.

In addition, the strontium titanate fine particles readily undergo uniform attachment to the magnetic toner particles in the case of a magnetic toner having a narrow particle diameter distribution, and as a consequence there is little particle-to-particle variation in the amount of attachment of the strontium titanate fine particles. This in turn makes the amount of strontium titanate fine particles uniform for the magnetic toner that flies from the developing sleeve to the electrostatic latent image-bearing member and creates an even greater suppression of variation in the charging performance due to separation charging.

It is thought that this control of the coverage ratio A, B/A, release rate for the strontium titanate fine particles, and particle diameter distribution into the hereinabove-indicated ranges makes it possible in the development step to achieve the generation of cloud development and efficient separation charging and to enhance the bias-following behavior even after standing in a severe environment and thus to suppress fogging and density reduction.

The binder resin in the magnetic toner in the present invention can be, for example, a vinyl resin or a polyester resin, but is not particularly limited and the heretofore known resins can be used.

Specifically, polystyrene or a styrene copolymer, e.g., a styrene-propylene copolymer, styrene-vinyltoluene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-octyl methacrylate copolymer, styrene-butadiene copolymer, styrene-isoprene copolymer, styrene-maleic acid copolymer, or styrene-maleate ester copolymer; as well as a polyacrylate ester; polymethacrylate ester; polyvinyl acetate; and so forth, can be used, and a single one of these may be used or a combination of a plurality of these may be used. Styrene copolymers and polyester resins are preferred among the preceding from the standpoint of, e.g., the developing characteristics and the fixing performance.

The glass-transition temperature (Tg) of the magnetic toner of the present invention is preferably from at least 40° C.

to not more than 70° C. When the glass-transition temperature of the magnetic toner is from at least 40° C. to not more than 70° C., the storage stability and durability can be enhanced while maintaining a favorable fixing performance.

A charge control agent is preferably added to the magnetic toner of the present invention.

Moreover, a negative-charging toner is preferred for the present invention.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids. Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention may as necessary also incorporate a release agent in order to improve the fixing performance. Any known release agent can be used for this release agent. Specific examples are petroleum waxes, e.g., paraffin wax, microcrystalline wax, and petrolatum, and their derivatives; montan waxes and their derivatives; hydrocarbon waxes provided by the Fischer-Tropsch method and their derivatives; polyolefin waxes, as typified by polyethylene and polypropylene, and their derivatives; natural waxes, e.g., carnauba wax and candelilla wax, and their derivatives; and ester waxes. Here, the derivatives include oxidized products, block copolymers with vinyl monomers, and graft modifications. In addition, the ester wax can be a monofunctional ester wax or a multifunctional ester wax, e.g., most prominently a difunctional ester wax but also a tetrafunctional or hexafunctional ester wax.

When a release agent is used in the magnetic toner of the present invention, its content is preferably from at least 0.5 mass parts to not more than 10 mass parts per 100 mass parts of the binder resin. When the release agent content is in the indicated range, the fixing performance is enhanced while the storage stability of the magnetic toner is not impaired.

The release agent can be incorporated in the binder resin by, for example, a method in which, during resin production, the resin is dissolved in a solvent, the temperature of the resin solution is raised, and addition and mixing are carried out while stirring, or a method in which addition is carried out during melt kneading during production of the magnetic toner.

The peak temperature (also referred to below as the melting point) of the highest endothermic peak measured on the release agent using a differential scanning calorimeter (DSC) is preferably from at least 60° C. to not more than 140° C. and more preferably is from at least 70° C. to not more than 130° C. When the peak temperature (melting point) of the highest endothermic peak is from at least 60° C. to not more than 140° C., the magnetic toner is easily plasticized during fixing and the fixing performance is enhanced. This is also preferred because it works against the appearance of outmigration by the release agent even during long-term storage.

The peak temperature of the highest endothermic peak of the release agent is measured in the present invention based on ASTM D3418-82 using a "Q1000" differential scanning calorimeter (TA Instruments, Inc.). Temperature correction in the instrument detection section is carried out using the melting points of indium and zinc, while the heat of fusion of indium is used to correct the amount of heat.

Specifically, approximately 10 mg of the measurement sample is precisely weighed out and this is introduced into an aluminum pan. Using an empty aluminum pan as the reference, the measurement is performed at a rate of temperature rise of 10° C./min in the measurement temperature range from 30 to 200° C. For the measurement, the temperature is raised to 200° C. and is then dropped to 30° C. at 10° C./min and is thereafter raised again at 10° C./min. The peak temperature of the highest endothermic peak is determined for the release agent from the DSC curve in the temperature range of 30 to 200° C. for this second temperature ramp-up step.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, cobalt, copper, lead, magnesium, tin, zinc, antimony, beryllium, bismuth, cadmium, calcium, manganese, selenium, titanium, tungsten, and vanadium.

The number-average particle diameter of the primary particles of these magnetic bodies is preferably not more than 2 μm and more preferably is from 0.05 to 0.50 μm.

With regard to the magnetic characteristics for the application of 79.6 kA/m, the coercive force (Hc) is preferably from 1.6 to 12.0 kA/m; the intensity of magnetization ($\sigma s$) is preferably from 30 to 90 $Am^2/kg$ and more preferably is from 40 to 80 $Am^2/kg$; and the residual magnetization ($\sigma r$) is preferably from 1 to 10 $Am^2/kg$ and more preferably is from 1.5 to 8 $Am^2/kg$.

The content of the magnetic body in the magnetic toner of the present invention is preferably from at least 35 mass % to not more than 50 mass % and more preferably is from at least 40 mass % to not more than 50 mass %.

Setting this range for the magnetic body content facilitates control to the desired dielectric characteristics in the present invention.

When the magnetic body content is less than 35 mass %, not only are the dielectric characteristics then difficult to control, but there is a reduced magnetic attraction to the magnet roll in the developing sleeve and fogging tends to readily occur. When, on the other hand, 50 mass % is exceeded, not only are the dielectric characteristics again difficult to control, but the developing performance tends to readily decline.

The content of the magnetic body in the magnetic toner can be measured using a TGA7 thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

In a magnetic field of 79.6 kA/m, the magnetic toner of the present invention has a ratio [$\sigma r/\sigma s$] of the residual magnetization ($\sigma r$) to the intensity of magnetization ($\sigma s$) preferably of not more than 0.09 and more preferably of not more than 0.06. A small [$\sigma r/\sigma s$] means that the magnetic toner has a small residual magnetization.

Here, when one considers magnetic monocomponent development, the magnetic toner is captured or discharged by the toner-carrying member under the effect of the multipole magnet present in the toner-carrying member. The discharged magnetic toner (the magnetic toner that has disengaged from the toner-carrying member) is resistant to magnetic cohesion when [σr/σs] has a small value. Such a magnetic toner does not undergo magnetic cohesion when it attaches to the toner-carrying member at a recapture pole again and enters the contact region, and as a consequence control of the amount of toner may be carried out precisely and the amount of magnetic toner on the toner-carrying member is stable. Due to this, the amount of magnetic toner in the contact region between the developing blade and the developing sleeve is stabilized and very good turn over by the magnetic toner in the contact region is obtained and the distribution of the amount of charge becomes very sharp. As a result, not only is ghosting improved, but the image density is also further increased and an image presenting little fogging is obtained.

[σr/σs] can be adjusted into the range indicated above by adjusting the particle diameter and shape of the magnetic body present in the magnetic toner and by adjusting the additives added during production of the magnetic body. Specifically, a high σs can be maintained and σr can be lowered by the addition of, for example, silica or phosphorus to the magnetic body. In addition, σr declines as the surface area of the magnetic body declines, and, with regard to shape, σr is smaller for a spherical shape, where there is little magnetic anisotropy, than for an octahedron. A very low σr can be achieved through a combination of the preceding, and [σr/σs] can thereby be controlled to not more than 0.09.

The intensity of magnetization (σs) and residual magnetization (σr) of the magnetic toner and magnetic body is measured in the present invention at a room temperature of 25° C. and an external magnetic field of 79.6 kA/m using a VSM P-1-10 vibrating sample magnetometer (Toei Industry Co., Ltd.). The reason for measuring the magnetic characteristics at an external magnetic field of 79.6 kA/m is that the magnetic force at the development pole of the magnet roller installed in a toner-carrying member is generally around 79.6 kA/m (1000 oersted). Due to this, toner behavior in the developing zone can therefore be comprehended by measuring the residual magnetization at an external magnetic field of 79.6 kA/m.

The magnetic toner of the present invention contains inorganic fine particles at the magnetic toner particle surface.

The inorganic fine particles present on the magnetic toner particle surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one type of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles.

The reasons for this are that silica fine particles not only provide the best balance with regard to imparting charging performance and flowability, but are also excellent from the standpoint of lowering the aggregative forces between the magnetic toners.

The reason why silica fine particles are excellent from the standpoint of lowering the aggregative forces between the magnetic toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one type of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a high image density can be obtained, which is strongly preferred.

Here, the timing and amount of addition of the inorganic fine particles may be adjusted in order to bring the silica fine particles to at least 85 mass % of the metal oxide fine particles present on the magnetic toner particle surface and in order to also bring the silica fine particles to at least 80 mass % with reference to the metal oxide particles fixed on the magnetic toner particle surface.

The amount of inorganic fine particles present can be checked using the methods described below for quantitating the inorganic fine particles.

The number-average particle diameter (D1) of the primary particles in the inorganic fine particles in the present invention is preferably from at least 5 nm to not more than 50 nm. The number-average particle diameter (D1) of the primary particles is more preferably from at least 10 nm to not more than 35 nm.

Bringing the number-average particle diameter (D1) of the primary particles in the inorganic fine particles into the indicated range facilitates favorable control of the coverage ratio A and B/A. When the primary particle number-average particle diameter (D1) is less than 5 nm, the inorganic fine particles tend to aggregate with one another and obtaining a large value for B/A becomes problematic and the coefficient of variation on the coverage ratio A is also prone to assume large values. When, on the other hand, the primary particle number-average particle diameter (D1) exceeds 50 nm, the coverage ratio A is prone to be small even at large amounts of addition of the inorganic fine particles; in addition, B/A will also tend to have a low value because it becomes difficult for the inorganic fine particles to become fixed to the magnetic toner particles. That is, it is difficult to obtain the above-described attachment force-reducing effect and bearing effect when the primary particle number-average particle diameter (D1) is greater than 50 nm.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, α-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a Henschel mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass parts to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS 28830 (2001). A "TriStar300 (Shimadzu Corporation) automatic specific surface area•pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

Setting the amount of addition of the inorganic fine particles in the indicated range is also preferred from the standpoint of facilitating appropriate control of the coverage ratio A and B/A and also from the standpoint of the image density and fogging.

Exceeding 3.0 mass parts for the amount of addition of the inorganic fine particles, even if an external addition apparatus and an external addition method could be devised, gives rise to release of the inorganic fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, or a spacer particle such as silica, may also be added in small amounts that do not influence the effects of the present invention.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to -4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner Particles 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours.

This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to -4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic particles are held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content (mass %) in the magnetic toner−silica content (mass %) in particle *A* amount of externally added titania fine particles (mass %)=titania content (mass %) in the magnetic toner−{titania content (mass %) in the magnetic body×magnetic body content *W*/100} amount of externally added alumina fine particles (mass %)=alumina content (mass %) in the magnetic toner−{alumina content (mass %) in the magnetic body×magnetic body content *W*/100}

(6) Calculation of the Proportion of Silica Fine Particles in the Metal Oxide Fine Particles Selected from the Group Consisting of Silica Fine Particles, Titania Fine Particles, and Alumina Fine Particles, for the Inorganic Fine Particles Fixed to the Magnetic Toner Particle Surface After carrying out the procedure, "Removing the unfixed inorganic fine particles", in the method described below for calculating the coverage ratio B and thereafter drying the magnetic toner, the proportion of the silica fine particles in the metal oxide fine particles can be calculated by carrying out the same procedures as in the method of (1) to (5) described above.

Strontium titanate fine particles are externally added to the magnetic toner particles in the magnetic toner of the present invention.

The number-average particle diameter (D1) of these strontium titanate fine particles is from at least 60 nm to not more than 300 nm and preferably is from at least 70 nm to not more than 250 nm and more preferably is from at least 80 nm to not more than 200 nm. When the number-average particle diameter (D1) of the strontium titanate fine particles is less than 60 nm, the specific surface area of the strontium titanate fine particles is increased and the hygroscopic behavior deteriorates, causing a decline in charging by the developer. Disturbances in the image are also caused by attachment to the members in the machine and a shortening of the life of the members in the machine is also readily induced. When, on the other hand, the strontium titanate fine particles have a number-average particle diameter (D1) greater than 300 nm, the strontium titanate fine particles are easily separated from the magnetic toner by the physical force in the developer container and magnetic toner charged up by separation charging is then ultimately retained on the developing sleeve. This produces a decline in density. Moreover, when strontium titanate fine particles with a number-average particle diameter (D1) above 300 nm are embedded in the magnetic toner particle surface using a strong force, separation does not occur in the developer container and the strontium titanate fine particles are also not separated from the magnetic toner even by the electrical force in the developing zone. Due to this, separation charging does not occur in the developing zone and the magnetic toner does not engage in development in conformity to the latent image.

The number-average particle diameter (D1) of the strontium titanate fine particles was determined by measuring 100 particle diameters on a photograph taken at an amplification of 50000× with an electron microscope and taking the arithmetic average thereof. For a spherical particle, its diameter was taken to be the particle diameter of the particle; for an elliptical spherical particle, the average value of the major and minor diameters was used as the particle diameter of the particle; and the average value of these was determined and taken to be the number-average particle diameter (D1).

The content of the strontium titanate fine particles, expressed with reference to the total amount of the magnetic toner including external additives, is from at least 0.1 mass % to not more than 3.0 mass %, preferably from at least 0.2 mass % to not more than 2.0 mass %, and even more preferably from at least 0.3 mass % to not more than 1.0 mass %. A satisfactory effect from its addition is obtained when addition is made within the indicated range, and as a consequence charge up within the developer container can be inhibited and separation charging in the developing zone can be satisfactorily brought about and the occurrence of problems such as fogging and density reduction can thereby be suppressed.

The method of producing the strontium titanate fine particles is not particularly limited, but production can be carried out, for example, by the following method.

An example of a general method for producing strontium titanate fine particles is a method in which sintering is carried out after a solid-phase reaction between titanium oxide and strontium carbonate.

A known reaction used in this production method can be represented by the following formula.

$$TiO_2+SrCO_3 \rightarrow SrTiO_3+CO_2$$

Thus, production is carried out by washing and drying a mixture containing titanium oxide and strontium carbonate and then carrying out sintering, mechanical pulverization, and classification. A composite inorganic fine powder containing strontium titanate, strontium carbonate, and titanium oxide can be obtained by adjusting the starting materials and the firing conditions.

The strontium carbonate starting material may be any substance that has the $SrCO_3$ composition, but is not otherwise particularly limited, and any commercial strontium carbonate may also be used. The number-average particle diameter of the strontium carbonate used as a starting material is preferably from at least 30 nm to not more than 200 nm and is more preferably from at least 50 nm to not more than 150 nm.

In addition, the titanium oxide starting material may be any substance that has the $TiO_2$ composition, but is not otherwise particularly limited. Examples of this titanium oxide include meta-titanic acid slurries obtained by the sulfuric acid method (undried hydrous titanium oxide) and titanium oxide powders. Meta-titanic acid slurries obtained by the sulfuric acid method are a preferred titanium oxide. This is due to the excellent uniform dispersibility in water-based wet methods. The number-average particle diameter of the titanium oxide is preferably from at least 20 nm to not more than 50 nm.

The molar ratio between these essential starting materials is not particularly limited, but is preferably $TiO_2$:$SrCO_3$=1.00:0.80 to 1.00:1.10, and the yield of the obtained strontium titanate fine particles may deteriorate when either the $TiO_2$ or $SrCO_3$ is in excess.

The sintering is preferably carried out at a temperature of 500 to 1300° C. and more preferably 650 to 1100° C. When the firing temperature is higher than 1300° C., sintering-induced secondary aggregation readily occurs between particles and a large load in the pulverization step then occurs. When the firing temperature is less than 600° C., large amounts of unreacted components remain and the production of stable strontium titanate fine particles is highly problematic.

The firing time is preferably 0.5 to 16 hours and is more preferably 1 to 5 hours. When the firing time is longer than 16 hours, the strontium carbonate and titanium oxide similarly completely react and the obtained strontium titanate particles may end up undergoing secondary aggregation. When the firing time is shorter than 0.5 hours, large amounts of unreacted components remain and the production of stable strontium titanate fine particles is highly problematic.

On the other hand, methods for producing the strontium titanate fine particles that do not go through a sintering step include a method in which synthesis is carried out by hydrolyzing an aqueous titanyl sulfate solution to obtain a hydrous titanium oxide slurry; adjusting the pH of this hydrous titanium oxide slurry to obtain a dispersion of a titania sol; adding strontium hydroxide to this titania sol dispersion; and heating to the reaction temperature. A titania sol with an excellent degree of crystallinity and particle diameter is obtained by making the pH of the hydrous titanium oxide slurry 0.5 to 1.0.

In addition, a basic substance such as sodium hydroxide is preferably added to the titania sol dispersion with the goal of removing the ions adsorbed to the titania sol particles. When this is done, the pH of the slurry is preferably not brought to 7 or above in order to avoid causing the adsorption of, e.g., the sodium ion, to the surface of the hydrous titanium oxide. In addition, the reaction temperature is preferably from 60° C. to 100° C.; the rate of temperature rise is preferably not more than 30° C./hour in order to obtain a desirable particle diameter distribution; and the reaction time is preferably 3 to 7 hours.

The following methods are examples of methods for subjecting the strontium titanate fine particles produced by a method as described above to surface treatment with a fatty acid or metal salt thereof. For example, a slurry of the strontium titanate fine particles may be introduced into an aqueous solution of the sodium salt of the fatty acid under an Ar gas or $N_2$ gas atmosphere and the fatty acid may be precipitated on the perovskite crystal surface. In addition, for example, a slurry of the strontium titanate fine particles may be introduced into an aqueous solution of the sodium salt of the fatty acid under an Ar gas or $N_2$ gas atmosphere and an aqueous solution of the desired metal salt may be added dropwise while stirring in order to precipitate and adsorb the fatty acid metal salt on the perovskite crystal surface. For example, aluminum stearate can be adsorbed when an aqueous sodium stearate solution and aluminum sulfate are used.

Viewed from the standpoint of the balance between the developing performance and the fixing performance, the magnetic toner of the present invention has a weight-average particle diameter (D4) preferably of 6.0 μm to 10.0 μm and more preferably 7.0 μm to 9.0 μm.

In addition, the average surface roughness (Ra) of the magnetic toner particles of the present invention, as measured using a scanning probe microscope, is preferably from at least 30.0 nm to not more than 70.0 nm for the magnetic toner of the present invention from the standpoint of improving the attachability of the strontium titanate fine particles to the magnetic toner particles and inhibiting charge up within the developer container.

When the average surface roughness of the magnetic toner particles is less than 30.0 nm, there is then little unevenness on the magnetic toner particle surface and as a result the strontium titanate fine particles are easily released by the force of friction with neighboring magnetic toner and separation charging occurs within the developer container. When, on the other hand, the average surface roughness of the magnetic toner particles is larger than 70.0 nm, a uniform dispersion of the strontium titanate fine particles cannot be achieved due to the unevenness of the magnetic toner particle surface and the strontium titanate fine particles undergo aggregation. This causes a reduction in the release rate of the strontium titanate fine particles in the developing zone. The unevenness of the magnetic toner particles is optimal when the average surface roughness of the magnetic toner particles is from at least 30.0 nm to not more than 70.0 nm and due to this the strontium titanate fine particles can be more uniformly dispersed on the magnetic toner particles. Furthermore, the presence of microscopic unevenness on the magnetic toner particle surface makes possible the dispersion of the frictional force with neighboring magnetic toner, as a consequence of which release of the strontium titanate fine particles within the developer container can be prevented. An image presenting little fogging and a high image density can be obtained as a result.

Examples of methods for producing the magnetic toner of the present invention are provided below, but there is no intent to limit the production method to these.

The magnetic toner of the present invention can be produced by any known method that has a step that enables adjustment of the coverage ratio A, B/A, the release rate of the strontium titanate fine particles, and [D4/D1] and that preferably has a step in which the coefficient of variation for coverage ratio A and the average surface roughness of the magnetic toner particles can be adjusted, while the other production steps are not particularly limited.

The following method is a favorable example of such a production method. First, the binder resin and magnetic body and as necessary other starting materials, e.g., a release agent and a charge control agent, are thoroughly mixed using a mixer such as a Henschel mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average surface roughness of the magnetic toner can be controlled by adjusting the exhaust gas temperature during micropulverization using a Turbo Mill. A lower exhaust gas temperature (for example, no more than 40° C.) provides a greater value for the average surface roughness while a higher exhaust gas temperature (for example, around 50° C.) provides a lower value for the average surface roughness.

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Among the preceding, adjustment of the amount of fines and coarse powder is preferred for adjusting [D4/D1], and an Elbow Jet can be advantageously used. Specifically, [D4/D1] can be lowered by lowering the amount of fines.

Figure 5:
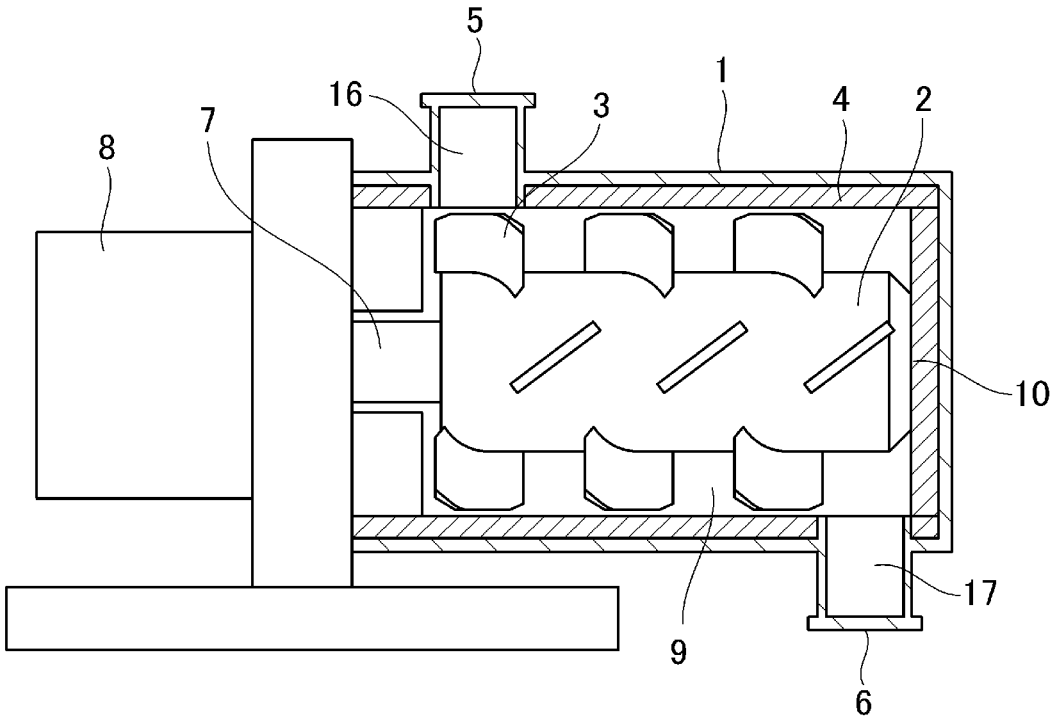
FIG. 5 is a schematic diagram that shows an example of a mixing process apparatus that can be used for the external addition and mixing of inorganic fine particles.

A known mixing process apparatus, e.g., the mixers described above, can be used as the mixing process apparatus for the external addition and mixing of the strontium titanate fine particles and inorganic fine particles (also referred to below simply as the inorganic fine particles); however, an apparatus as shown in FIG. 5 is preferred from the standpoint of enabling facile control of the coverage ratio A, B/A, the release rate for the strontium titanate fine particles, and the coefficient of variation on the coverage ratio A.

FIG. 5 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, the release rate for the strontium titanate fine particles, and the coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 6:
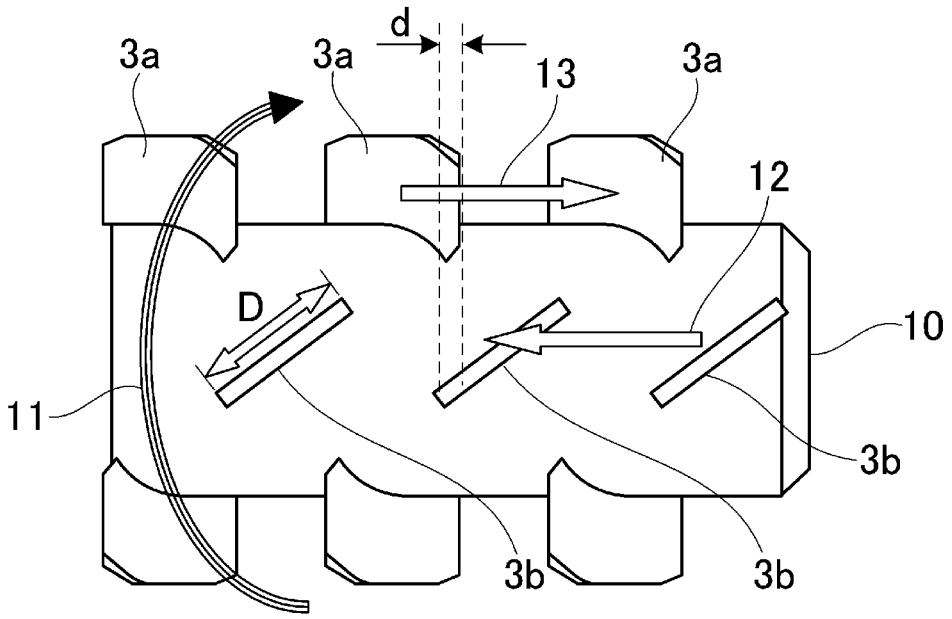
FIG. 6 is a schematic diagram that shows an example of the structure of a stirring member used in the mixing process apparatus.

On the other hand, FIG. 6 is a schematic diagram that shows an example of the structure of the stirring member used in the aforementioned mixing process apparatus.

The external addition and mixing process for the inorganic fine particles is described below using FIGS. 5 and 6.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 5, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 6, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 5, the direction toward the product discharge port 6 from the raw material inlet port 5 (the direction to the right in FIG. 5) is the "forward direction".

That is, as shown in FIG. 6, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 6, two members at an interval of 180° with each other form a set of the stirring members 3*a*, 3*b* on the rotating member 2, but a larger number of members may form a set, such as three at an interval of 120° or four at an interval of 90°.

In the example shown in FIG. 6, a total of twelve stirring members 3*a*, 3*b* are formed at an equal interval.

Furthermore, D in FIG. 6 indicates the width of a stirring member and d indicates the distance that represents the overlapping portion of a stirring member. In FIG. 6, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 6 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 6, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 5 and 6.

The apparatus shown in FIG. 5 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 5 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing 1 to the outside, the magnetic toner that has been subjected to the external addition and mixing process.

The apparatus shown in FIG. 5 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a Henschel mixer and the mixture may thereafter be introduced through the raw material inlet port 5 of the apparatus shown in FIG. 5.

More specifically, with regard to the conditions for the external addition and mixing process, controlling the power of the drive member 8 to from at least 0.2 W/g to not more than 2.0 W/g is preferred in terms of obtaining the coverage ratio A, B/A, the release rate for the strontium titanate fine particles, and the coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 5, the volume of the processing space 9 in the apparatus is $2.0\times10^{-3}$ $m^3$, the rpm of the stirring members—when the shape of the stirring members 3 is as shown in FIG. 6—is preferably from at least 1000 rpm to not more than 3000 rpm. The coverage ratio A, B/A, the release rate for the strontium titanate fine particles, and the coefficient of variation for the coverage ratio A specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

Furthermore, in a particularly preferred processing method in the present invention for increasing the release rate of the strontium titanate, an external addition and mixing process is carried out using only the inorganic fine particles (for example, silica fine particles) followed by the addition of the strontium titanate and execution of an external addition and mixing process. Covering the magnetic toner particle surface with inorganic fine particles (for example, silica fine particles) makes it possible to disperse the strontium titanate on the magnetic toner particle surface without embedding the strontium titanate and can raise the release rate of the strontium titanate.

More specifically, the following are preferred for the conditions for the external addition process for only the inorganic fine particles (for example, silica fine particles): use of a Henschel mixer (Mitsui Mining Co., Ltd.), a stirring member rotation rate of from at least 3000 rpm to not more than 4000 rpm, and a processing time of from 0.5 minutes to not more than 1.5 minutes. It is difficult to achieve a satisfactorily uniform mixing of the silica fine particles with the magnetic toner particles when a rotation rate of less than 3000 rpm or a processing time of less than 0.5 minutes is used for the external addition process conditions for only the silica fine particles. On the other hand, the silica fine particles may end up becoming embedded in the magnetic toner particle surface when not less than 4000 rpm or a process time longer than 1.5 minutes is used for the external addition process conditions for only the silica fine particles.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 4:
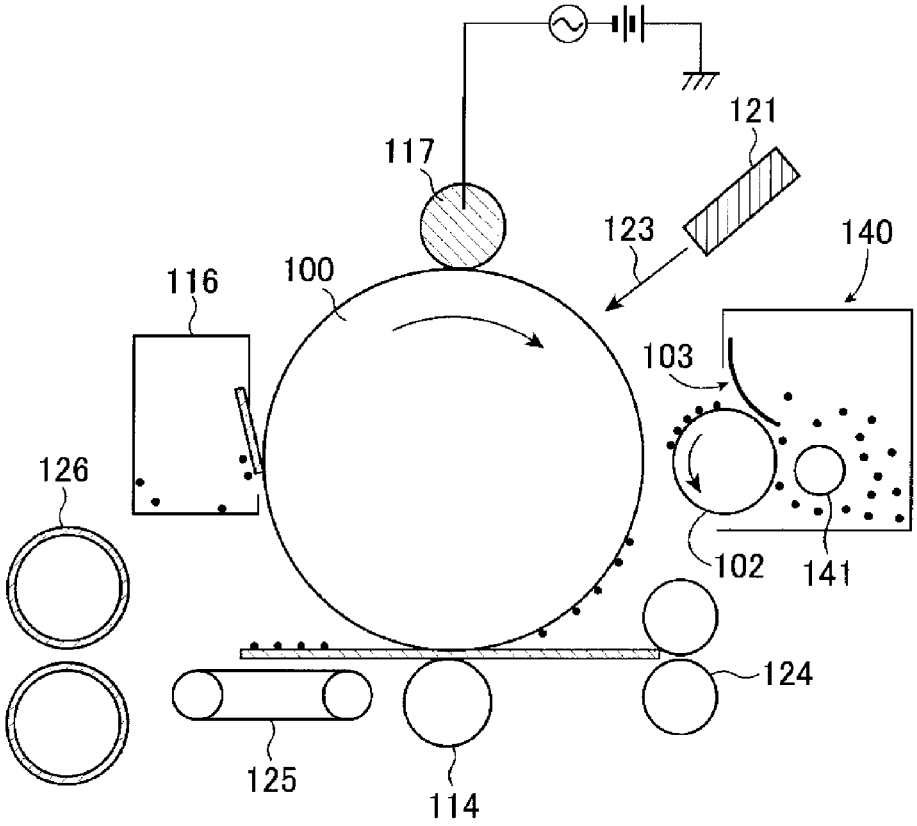
FIG. 4 is a diagram that shows an example of an image-forming apparatus.

An example of an image-forming apparatus that can advantageously use the magnetic toner of the present invention is specifically described below with reference to FIG. 4. In FIG. 4, 100 is an electrostatic latent image-bearing member (also referred to below as a photosensitive member), and the following, inter alia, are disposed on its circumference: a charging member 117 (hereinafter also called a charging roller), a developing device 140 having a toner-carrying member 102, a transfer member 114 (transfer roller), a cleaner 116, a fixing unit 126, and a register roller 124. The electrostatic latent image-bearing member 100 is charged by the charging member 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer member 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner 116.

The methods for measuring the various properties referenced by the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the S-4800

The coverage ratio A is calculated using the image obtained by backscattered electron imaging with the S-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper(U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a\ (\%)=100-(D/C\times 100)$$

As noted above, calculation of the coverage ratio a is carried out for at least 30 magnetic toner particles. The average value of all the obtained data is taken to be the coverage ratio A of the present invention.

<The Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation } (\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 7:
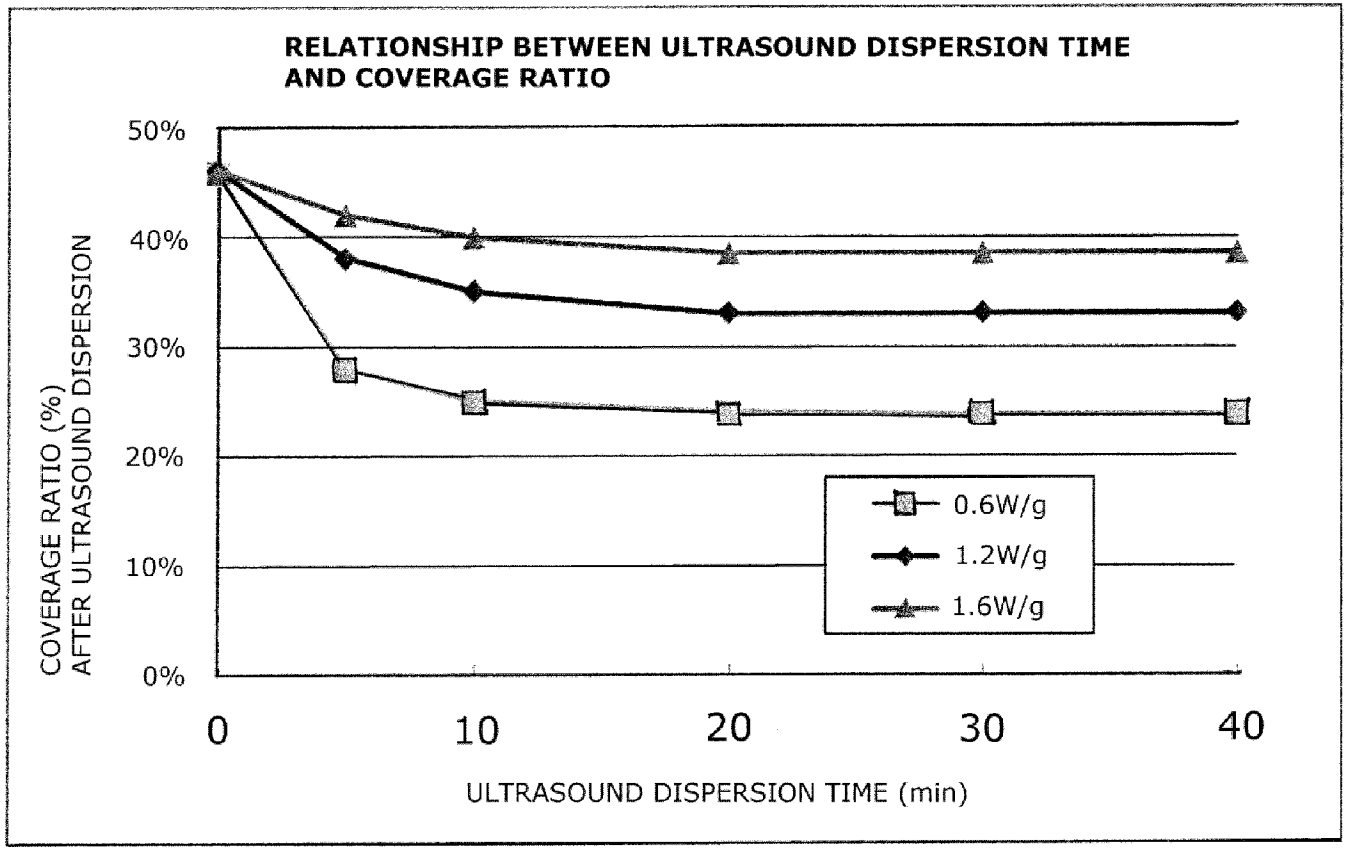
FIG. 7 is a diagram that shows an example of the relationship between the ultrasound dispersion time and the coverage ratio.

As an example, FIG. 7 shows the relationship between the ultrasound dispersion time and the coverage ratio calculated post-ultrasound dispersion, for magnetic toners in which the coverage ratio A was brought to 46% using the apparatus shown in FIG. 5 at three different external addition intensities. FIG. 7 was constructed by calculating, using the same procedure as for the calculation of coverage ratio A as described above, the coverage ratio of a magnetic toner provided by removing the inorganic fine particles by ultrasound dispersion by the method described below and then drying.

FIG. 7 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes.

Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the toner is calculated as for the coverage ratio A described above, to obtain the coverage ratio B.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/ALIGNMENT knobs as in (4); and focusing autofocus. The focus adjustment process is repeated to achieve focus at 100000×.

After this, the particle diameter is measured on at least 300 inorganic fine particles on the magnetic toner surface and the primary particle number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Method for Measuring the Weight-Average Particle Diameter (D4) and the Number-Average Particle Diameter (D1) of the Magnetic Toner>

The weight-average particle diameter (D4) and number-average particle diameter (D1) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the round-bottom beaker set in the sample stand as described in (1) with adjustment to provide a measurement concentration of about 5%. Measurement is then performed until the number of measured particles reaches 50000.

(7) The measurement data is analyzed by the previously cited dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4); when set to graph/number % with the dedicated software, the "average diameter" on the "analysis/numerical statistical value (arithmetic average)" screen is the number-average particle diameter (D1).

<Method of Measuring the Average Surface Roughness of the Magnetic Toner Particles>

The average surface roughness of the magnetic toner particles is measured using a scanning probe microscope. An example of the measurement method is provided below.

probe station: SPI3800N (Seiko Instruments Inc.)

measurement unit: SPA400 measurement mode: DFM (resonance mode) topographic image cantilever: SI-DF40P resolution: number of X data=256, number of Y data=128

A 1 μm square area of the magnetic toner particle surface is measured in the present invention. The measured area is taken to be a 1 μm square area in the center of the magnetic toner particle surface measured with the scanning probe microscope. For the measured magnetic toner particles, magnetic toner particles equal to the weight-average particle diameter (D4) measured by the Coulter Counter method are randomly selected and these magnetic toner particles are measured. Secondary correction is performed on the measurement data. At least five different magnetic toner particles are measured and the average value of the obtained data is calculated and taken to be the average surface roughness of the magnetic toner particles.

When the surface of a magnetic toner particle is measured using a scanning probe microscope in the case of toner provided by the external addition of an external additive to the magnetic toner particles, the external additive must be removed, and the following method is an example of a specific method for this.

1) Introduce 45 mg of the magnetic toner particles into a sample flask and add 10 mL methanol.

2) Separate the external additive by dispersing the sample for 1 minute with an ultrasound cleaner.

3) Position a magnet at the bottom of the sample bottle to immobilize the magnetic toner particles and separate only the supernatant.

4) Carry out 2) and 3) a total of three times and thoroughly dry the obtained magnetic toner particles at room temperature using a vacuum drier.

The absence of external additive is confirmed using a scanning electron microscope to observe the magnetic toner particles from which the external additive has been removed, followed by observation of the surface of the magnetic toner particles with the scanning probe microscope. When the external additive has not been thoroughly removed, 2) and 3) are repeated until the external additive has been thoroughly removed, followed by observation of the surface of the magnetic toner particles with the scanning probe microscope.

Dissolution of the external additive with an alkali is an example of a method for removing the external additive other than 2) and 3). An aqueous solution of sodium hydroxide is preferred for the alkali.

The average surface roughness (Ra) is considered in the following.

The average surface roughness (Ra) in the present invention is the center line average roughness Ra defined in JIS B 0601 that has been three-dimensionally expanded to be applicable to a measurement plane. It is the value provided by averaging the absolute value of the deviation from the reference place to a designated plane, and is given by the following equation.

$$Ra = \frac{1}{S_0}\int_{Y_B}^{Y_T}\int_{X_L}^{X_R}|F(X, Y) - Z_0|\,dX\,dY \qquad \text{[Math. 1]}$$

<Method of Measuring the Release Rate of the Strontium Titanate Fine Particles>

An electrostatic-type instrument for measuring amount of charge, from Kabushiki Kaisha Etwas, is used in order to separate the strontium titanate fine particles from the magnetic toner. The use of this measurement instrument makes it possible to effectively and thoroughly separate the strontium titanate fine particles in the magnetic toner. 5.0 g of the magnetic toner was used once for the separation of the strontium titanate fine particles from the magnetic toner.

The magnetic toner is set in the sleeve of the instrument, and, while applying an impressed voltage of −3 kV, the magnet (1000 gauss) within the sleeve is rotated at 2000 rpm for 1 minute. When this is done, only the strontium titanate fine particles fly to the inside of a cylinder (stainless) positioned separated by a 5 mm gap on the periphery of the sleeve, while only the magnetic toner remains on the sleeve. This magnetic toner is sampled and this sample is subjected to fluorescent x-ray measurement. Here, the x-ray intensity is measured for the metal element (strontium in the present case) present in the sample (magnetic toner). The fluorescent x-ray intensity of the strontium titanate fine particles is measured for both the magnetic toner prior to separation of the strontium titanate fine particles and the magnetic toner after separation (fluorescent x-ray intensity [X1] before separation of the strontium titanate fine particles and fluorescent x-ray intensity [X2] after separation). The release rate is obtained using the following formula.

$$\text{strontium titanate fine particle release rate (\%)} = \{1 - X2/X1\} \times 100 \qquad \text{(formula)}$$

<Method of Measuring the Content of the Strontium Titanate Fine Particles with Reference to the Total Amount of the Magnetic Toner>

An "Axios" wavelength-dispersive fluorescent x-ray analyzer (PANalytical B.V.) is used to measure the content of the strontium titanate fine particles with reference to the total amount of the magnetic toner, and "SuperQ ver. 4.0F" (PANalytical B.V.) dedicated software provided with the instrument is used to set measurement conditions and to analyze the measurement data. Rh is used as the anode of the x-ray tube; the measurement atmosphere is a vacuum; the measurement diameter (collimator mask diameter) is 27 mm; and the measurement time is 10 seconds. In addition, detection is performed with a proportional counter (PC) in the case of light element measurement, while detection is performed with a scintillation counter (SC) in the case of heavy element detection.

For the measurement sample, approximately 4 g of the sample is introduced into the dedicated aluminum ring for pressing and is leveled out and pressure is applied for 60 seconds at 20 MPa using a "BRE-32" tablet compression molder (Maekawa Testing Machine Mfg. Co., Ltd.), and the pellet molded to a thickness of approximately 2 mm and a diameter of approximately 39 mm is used as the measurement sample.

Measurement is carried out using the conditions given above; the elements are identified based on the position of the obtained x-ray peaks; their concentrations are calculated from the counting rate (unit: cps), which is the number of x-ray photons per unit time; and the content (mass %) of the strontium titanate fine particles with reference to the total amount of magnetic toner is calculated from the calibration curve.

EXAMPLES

The present invention is more specifically described through the production examples and examples provided below, but the present invention is in no way restricted to these. The number of parts and % in the following blends, unless specifically indicated otherwise, are in all instances on a mass basis.

Production Example for Strontium Titanate Fine Particle 1

A titanyl sulfate powder was dissolved in distilled water to provide a Ti concentration in the solution of 1.5 (mol/L). Sulfuric acid and distilled water were then added to this solution so as to provide a sulfuric acid concentration at the completion of the reaction of 2.8 (mol/L). A hydrolysis reaction was carried out by heating this solution for 36 hours at 110° C. in a sealed container. After this, washing with water was carried out until the sulfuric acid and impurities had been thoroughly removed to obtain a meta-titanic acid slurry. To this slurry was added strontium carbonate (number-average particle diameter=80 nm) in an amount equimolar to the titanium oxide. After thorough mixing in the aqueous medium, washing and drying were carried out followed by calcination for 4 hours at 1000° C., pulverization by mechanical impact, and classification to obtain strontium titanate fine particle 1 having a number-average particle diameter of 110 nm. The number-average particle diameter of the obtained strontium titanate fine particle 1 is shown in Table 1.

Production Examples for Strontium Titanate Fine Particles 2 to 8

Using the meta-titanic acid slurry described above, strontium titanate fine particles 2 to 8 were obtained proceeding as in the Production Example for Strontium Titanate Fine Particle 1, but changing the particle diameter of the strontium carbonate used and the firing conditions as shown in Table 1 and adjusting the pulverization and classification conditions as appropriate. The number-average particle diameter of the resulting strontium titanate fine particles 2 to 8 is shown in Table 1.

Production Example for Strontium Titanate Fine Particle 9

A hydrous titanium oxide slurry obtained by hydrolyzing an aqueous titanyl sulfate solution was washed with an aqueous alkali solution. Hydrochloric acid was then added to this hydrous titanium oxide slurry to adjust the pH to 0.7 and obtain a titania sol dispersion. The pH of the dispersion was adjusted to 5.0 by adding NaOH to the titania sol dispersion, and washing was repeated until the electrical conductivity of the supernatant reached 70 μS/cm.

$Sr(OH)_2.8H_2O$, in an amount that was 0.98-fold on a molar basis with respect to the hydrous titanium oxide, was added followed by introduction into an SUS reactor and substitution with nitrogen gas. Distilled water was then added to bring to 0.5 mol/L as $SrTiO_3$. The slurry was heated at 7° C./hour to 80° C. under the nitrogen atmosphere, and, after reaching 80° C., a reaction was carried out for 6 hours. The reaction was followed by cooling to room temperature, removal of the supernatant, repeated washing with pure water, and then filtration on a Nutsche filter. The resulting cake was dried to obtain strontium titanate fine particle 9 without going through a sintering step. The number-average particle diameter of strontium titanate fine particle 9 is given in Table 1.

TABLE 1

| | particle diameter of the starting $SrCO_3$ (nm) | sintering temperature (° C.) | sintering time (h) | number-average particle diameter of the strontium titanate (nm) |
|---|---|---|---|---|
| strontium titanate fine particle 1 | 80 | 900 | 4 | 110 |
| strontium titanate fine particle 2 | 80 | 850 | 6 | 80 |
| strontium titanate fine particle 3 | 150 | 800 | 7 | 200 |
| strontium titanate fine particle 4 | 80 | 800 | 8 | 70 |
| strontium titanate fine particle 5 | 160 | 850 | 5 | 250 |
| strontium titanate fine particle 6 | 180 | 900 | 5 | 300 |
| strontium titanate fine particle 7 | 50 | 900 | 3 | 60 |
| strontium titanate fine particle 8 | 210 | 800 | 7 | 350 |
| strontium titanate fine particle 9 | — | — | — | 100 |

Magnetic Body 1 Production Example

An aqueous solution containing ferrous hydroxide was prepared by mixing the following in an aqueous solution of ferrous sulfate: a sodium hydroxide solution at 1.1 equivalent with reference to the iron, $SiO_2$ in an amount that provided 0.60 mass % as silicon with reference to the iron, and sodium phosphate in an amount that provided 0.15 mass % as phosphorus with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was subsequently run while blowing in air and maintaining the slurry at pH 7.5 to obtain a slurry containing magnetic iron oxide. This slurry was filtered, washed, dried, and ground to obtain a magnetic body 1 that had a primary particle number-average particle diameter of 0.21 μm and a intensity of magnetization of 66.5 $Am^2/kg$ and residual magnetization of 4.3 $Am^2/kg$ for a magnetic field of 79.6 kA/m (1000 oersted).

Magnetic Body 2 Production Example

An aqueous solution containing ferrous hydroxide was prepared by mixing the following in an aqueous solution of ferrous sulfate: a sodium hydroxide solution at 1.1 equivalent with reference to the iron and $SiO_2$ in an amount that provided 0.60 mass % as silicon with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was subsequently run while blowing in air and maintaining the slurry at pH 8.5 to obtain a slurry containing magnetic iron oxide. This slurry was filtered, washed, dried, and ground to obtain a magnetic body 2 that had a primary particle number-average particle diameter of 0.22 μm and a intensity of magnetization of 66.1 $Am^2/kg$ and residual magnetization of 5.9 $Am^2/kg$ for a magnetic field of 79.6 kA/m (1000 oersted).

Magnetic Body 3 Production Example

An aqueous solution containing ferrous hydroxide was prepared by mixing the following in an aqueous solution of ferrous sulfate: a sodium hydroxide solution at 1.1 equivalent with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was subsequently run while blowing in air and maintaining the slurry at pH 12.8 to obtain a slurry containing magnetic iron oxide. This slurry was filtered, washed, dried, and ground to obtain a magnetic body 3 that had a primary particle number-average particle diameter of 0.20 μm and a intensity of magnetization of 65.9 $Am^2/kg$ and residual magnetization of 7.3 $Am^2/kg$ for a magnetic field of 79.6 kA/m (1000 oersted).

<Production of Magnetic Toner Particle 1>

| | |
|---|---|
| styrene/n-butyl acrylate copolymer 1 parts (St/nBA copolymer 1 in Table 2) (styrene and n-butyl acrylate mass ratio = 78:22, glass-transition temperature (Tg) = 58° C., peak molecular weight = 8500) | 100.0 mass |
| magnetic body 1 parts | 95.0 mass |
| polyethylene wax (melting point: 102° C.) parts | 5.0 mass |
| iron complex of monoazo dye parts (T-77: Hodogaya Chemical Co., Ltd.) | 2.0 mass |

The raw materials listed above were preliminarily mixed using an FM10C Henschel mixer (Mitsui Miike Chemical Engineering Machinery Co., Ltd.). This was followed by kneading with a twin-screw kneader/extruder (PCM-30, Ikegai Ironworks Corporation) set at a rotation rate of 250 rpm with the set temperature being adjusted to provide a direct temperature in the vicinity of the outlet for the kneaded material of 145° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 25.0 kg/hr with the air temperature adjusted to provide an exhaust gas temperature of 38° C.; and classification was performed using a Coanda effect-based multifraction classifier to obtain a magnetic toner particle 1 having a weight-average particle diameter (D4) of 8.4 μm and an average surface roughness (Ra) of 42.4 nm. The production conditions for magnetic toner particle 1 are shown in Table 2.

<Production of Magnetic Toner Particle 2>

A magnetic toner particle 2 with a weight-average particle diameter (D4) of 8.5 μm and an average surface roughness (Ra) of 42.0 nm was obtained proceeding as in Production of Magnetic Toner Particle 1, but using magnetic body 2 in place of the magnetic body 1 in Production of Magnetic Toner Particle 1. The production conditions for magnetic toner particle 2 are shown in Table 2.

<Production of Magnetic Toner Particle 3>

A magnetic toner particle 3 with a weight-average particle diameter (D4) of 8.2 μm and an average surface roughness (Ra) of 69.2 nm was obtained proceeding as in Production of Magnetic Toner Particle 2, but changing the fine pulverization apparatus to a jet mill pulverizer and using 3.0 kg/hr for the feed rate and 3.0 kPa for the pulverization pressure. The production conditions for magnetic toner particle 3 are shown in Table 2.

<Production of Magnetic Toner Particle 4>

A magnetic toner particle 4 with a weight-average particle diameter (D4) of 8.3 μm and an average surface roughness (Ra) of 31.2 nm was obtained proceeding as in Production of Magnetic Toner Particle 2, but controlling the exhaust temperature of the Turbo Mill T-250 in the Production of Magnetic Toner Particle 2 to a high 48° C. to adjust the average surface roughness of the magnetic toner particles downward. The production conditions for magnetic toner particle 4 are shown in Table 2.

<Production of Magnetic Toner Particle 5>

A magnetic toner particle 5 with a weight-average particle diameter (D4) of 8.1 μm and an average surface roughness (Ra) of 67.3 nm was obtained proceeding as in Production of Magnetic Toner Particle 3, but changing the styrene/n-butyl acrylate copolymer 1 (styrene and n-butyl acrylate mass ratio=78:22, glass-transition temperature (Tg)=58° C., peak molecular weight=8500) in Production of Magnetic Toner Particle 3 to a styrene/n-butyl acrylate copolymer 2 (styrene and n-butyl acrylate mass ratio=78:22, glass-transition temperature (Tg)=57° C., peak molecular weight=6500; St/nBA copolymer 2 in Table 2). The production conditions for magnetic toner particle 5 are shown in Table 2.

<Production of Magnetic Toner Particle 6>

A magnetic toner particle 6 with a weight-average particle diameter (D4) of 8.1 μm and an average surface roughness (Ra) of 65.1 nm was obtained proceeding as in Production of Magnetic Toner Particle 5, with the exception that the classification conditions in Production of Magnetic Toner Particle 5 were changed so as to incorporate the fines. The production conditions for magnetic toner particle 6 are shown in Table 2.

<Production of Magnetic Toner Particle 7>

A magnetic toner particle 7 with a weight-average particle diameter (D4) of 8.3 μm and an average surface roughness (Ra) of 68.5 nm was obtained proceeding as in Production of Magnetic Toner Particle 5, but using magnetic body 3 in place of the magnetic body 2 in Production of Magnetic Toner Particle 5. The production conditions for magnetic toner particle 7 are shown in Table 2.

<Production of Magnetic Toner Particle 8>

A magnetic toner particle 8 with a weight-average particle diameter (D4) of 8.5 μm and an average surface roughness (Ra) of 42.0 nm was obtained proceeding as in Production of Magnetic Toner Particle 1, but using magnetic body 3 in place of magnetic body 1. The production conditions for magnetic toner particle 8 are shown in Table 2.

<Production of Magnetic Toner Particle 9>

A magnetic toner particle 9 with a weight-average particle diameter (D4) of 8.1 μm and an average surface roughness (Ra) of 72.1 nm was obtained proceeding as in Production of Magnetic Toner Particle 5, with the exception that the feed rate for the jet mill pulverizer in Production of Magnetic Toner Particle 5 was 2.0 kg/hr and the pulverization pressure was 1.5 kPa and magnetic body 3 was used in place of magnetic body 2. The production conditions for magnetic toner particle 9 are shown in Table 2.

<Production of Magnetic Toner Particle 10>

A magnetic toner particle 10 with a weight-average particle diameter (D4) of 8.0 μm and an average surface roughness (Ra) of 19.8 nm was obtained proceeding as in Production of Magnetic Toner Particle 8, but subjecting the magnetic toner particle 8 provided by classification in Production of Magnetic Toner Particle to surface modification and fines removal using a Faculty (Hosokawa Micron Corporation) surface modification device and using 8.6 kg per cycle for the amount of finely pulverized product introduction and adjusting the peripheral rotation velocity of the dispersion rotor, the cycle time (time from completion of the raw material feed to opening of the exhaust valve), the exhaust temperature, and the number of times of surface treatment based on the production conditions in Table 2. The production conditions for magnetic toner particle 10 are shown in Table 2.

<Production of Magnetic Toner Particle 11>

A magnetic toner particle 11 with a weight-average particle diameter (D4) of 8.0 μm and an average surface roughness (Ra) of 67.5 nm was obtained proceeding as in Production of Magnetic Toner Particle 5, with the exception that the classification conditions in Production of Magnetic Toner Particle 5 were changed so as to incorporate the fines. The production conditions for magnetic toner particle 11 are shown in Table 2.

<Production of Magnetic Toner Particle 12>

A magnetic toner particle 12 with a weight-average particle diameter (D4) of 8.1 μm and an average surface roughness (Ra) of 68.2 nm was obtained proceeding as in Production of Magnetic Toner Particle 3, with the exception that the classification conditions in Production of Magnetic Toner Particle 3 were changed so as to incorporate the fines. The production conditions for magnetic toner particle 12 are shown in Table 2.

<Production of Magnetic Toner Particle 13>

External addition prior to a hot wind treatment was performed by mixing 100 mass parts of magnetic toner particle 6 using an FM10C Henschel mixer (Mitsui Miike Chemical Engineering Machinery Co., Ltd.) with 0.5 mass parts of the silica fine particles used in the external addition and mixing process of Magnetic Toner Production Example 1, infra. The external addition conditions here were a rotation rate of 3000 rpm and a processing time of 2 minutes. Then, after being subjected to this external addition prior to a hot wind treatment, the magnetic toner particles were subjected to surface modification using a Meteorainbow (Nippon Pneumatic Mfg. Co., Ltd.), which is a device that carries out the surface modification of toner particles using a hot wind blast. The surface modification conditions were a raw material feed rate of 2 kg/hr, a hot wind flow rate of 700 L/min, and a hot wind ejection temperature of 300° C. Magnetic toner particles 13 having a weight-average particle diameter (D4) of 8.3 μm and an average surface roughness (Ra) of 4.1 nm were obtained by carrying out this hot wind treatment. The production conditions for magnetic toner particle 13 are shown in Table 2.

<Production of Magnetic Toner Particle 14>

Magnetic toner particle 14 having a weight-average particle diameter (D4) of 8.1 μm and an average surface roughness (Ra) of 4.3 nm was obtained by proceeding as in Production of Magnetic Toner Particle 13, but in this case using 1.5 mass parts for the amount of addition of the silica fine particles in the external addition prior to the hot wind treatment in Production of Magnetic Toner Particle 13. The production conditions for magnetic toner particle 14 are shown in Table 2.

TABLE 2

| | | | | | pulverization conditions at the mechanical pulverizer | | air temperature at the |
|---|---|---|---|---|---|---|---|
| | binder resin | magnetic body | amount of wax addition | pulverization device | feed rate (kg/hr) | pulverization pressure (kPa) | mechanical pulverizer exhaust temperature during pulverization |
| magnetic toner particle 1 | St/nBA copolymer 1 | magnetic body 1 | 5 mass parts polyethylene | Turbo Mill | 25.0 | — | 38° C. |
| magnetic toner particle 2 | St/nBA copolymer 1 | magnetic body 2 | 5 mass parts polyethylene | Turbo Mill | 25.0 | — | 36° C. |
| magnetic toner particle 3 | St/nBA copolymer 1 | magnetic body 2 | 5 mass parts polyethylene | Jet Mill | 3.0 | 3.0 | — |
| magnetic toner particle 4 | St/nBA copolymer 1 | magnetic body 2 | 5 mass parts polyethylene | Turbo Mill | 25.0 | — | 48° C. |
| magnetic toner particle 5 | St/nBA copolymer 2 | magnetic body 2 | 5 mass parts polyethylene | Jet Mill | 3.0 | 3.0 | — |
| magnetic toner particle 6 | St/nBA copolymer 2 | magnetic body 2 | 5 mass parts polyethylene | Jet Mill | 3.0 | 3.0 | — |
| magnetic toner particle 7 | St/nBA copolymer 2 | magnetic body 3 | 5 mass parts polyethylene | Jet Mill | 3.0 | 3.0 | — |
| magnetic toner particle 8 | St/nBA copolymer 1 | magnetic body 3 | 5 mass parts polyethylene | Turbo Mill | 25.0 | — | 38° C. |

TABLE 2-continued

| | | | | | | | |
|---|---|---|---|---|---|---|---|
| magnetic toner particle 9 | St/nBA copolymer 2 | magnetic body 3 | 5 mass parts polyethylene | Jet Mill | 2.0 | 1.5 | — |
| magnetic toner particle 10 | St/nBA copolymer 1 | magnetic body 3 | 5 mass parts polyethylene | Turbo Mill | 25.0 | — | 38° C. |
| magnetic toner particle 11 | St/nBA copolymer 2 | magnetic body 2 | 5 mass parts polyethylene | Jet Mill | 3.0 | 3.0 | — |
| magnetic toner particle 12 | St/nBA copolymer 1 | magnetic body 2 | 5 mass parts polyethylene | Jet Mill | 3.0 | 3.0 | — |
| magnetic toner particle 13 | St/nBA copolymer 2 | magnetic body 2 | 5 mass parts polyethylene | Jet Mill | 3.0 | 3.0 | — |
| magnetic toner particle 14 | St/nBA copolymer 2 | magnetic body 2 | 5 mass parts polyethylene | Jet Mill | 3.0 | 3.0 | — |

| | surface modification conditions | | | | average |
|---|---|---|---|---|---|
| | peripheral velocity of the dispersion rotor (m/sec) | cycle time (sec) | exhaust temperature (° C.) | classification conditions | surface roughness (nm) |
| magnetic toner particle 1 | — | — | — | condition 1 | 42.1 |
| magnetic toner particle 2 | — | — | — | condition 1 | 42.5 |
| magnetic toner particle 3 | — | — | — | condition 1 | 69.1 |
| magnetic toner particle 4 | — | — | — | condition 1 | 31.0 |
| magnetic toner particle 5 | — | — | — | condition 1 | 67.9 |
| magnetic toner particle 6 | — | — | — | condition 2 | 67.2 |
| magnetic toner particle 7 | — | — | — | condition 1 | 68.5 |
| magnetic toner particle 8 | — | — | — | condition 1 | 42.8 |
| magnetic toner particle 9 | — | — | — | condition 1 | 72.1 |
| magnetic toner particle 10 | 130 | 82 | 38 | condition 1 | 19.8 |
| magnetic toner particle 11 | — | — | — | condition 3 | 67.5 |
| magnetic toner particle 12 | — | — | — | condition 2 | 68.2 |
| magnetic toner particle 13 | — | — | — | condition 2 | 4.1 |
| magnetic toner particle 14 | — | — | — | condition 2 | 4.3 |

Magnetic Toner Production Example 1

An external addition and mixing process was carried out using the apparatus shown in FIG. 5 on the magnetic toner particle 1 provided by Magnetic Toner Particle Production Example 1.

In this example, a Henschel mixer (Mitsui Miike Chemical Engineering Machinery Co., Ltd., FM-10C) was used for a pre-external addition, which was followed by a main external addition using the apparatus shown in FIG. 5, in which the diameter of the inner circumference of the main casing 1 was 130 mm; the apparatus used had a volume for the processing space 9 of $2.0\times10^{-3}$ $m^3$; the rated power for the drive member 8 was 5.5 kW; and the stirring member 3 had the shape given in FIG. 6. The overlap width d in FIG. 6 between the stirring member 3*a* and the stirring member 3*b* was 0.25 D with respect to the maximum width D of the stirring member 3, and the clearance between the stirring member 3 and the inner circumference of the main casing 1 was 3.0 mm.

100 mass parts of magnetic toner particles 1 and 2.00 mass parts of the silica fine particles 1 described below were introduced into a Henschel mixer.

Silica fine particles 1 were obtained by treating 100 mass parts of a silica with a BET specific surface area of 130 $m^2/g$ and a primary particle number-average particle diameter (D1) of 16 nm with 10 mass parts hexamethyldisilazane and then with 10 mass parts dimethylsilicone oil.

A pre-mixing was carried out in order to uniformly mix the magnetic toner particles and the silica fine particles. The pre-mixing conditions were as follows: blade rotation rate of 4000 rpm for 1 minute of processing.

The external addition and mixing process was carried out with the apparatus shown in FIG. 5 once pre-mixing was finished. With regard to the conditions for the external addition and mixing process, the processing time was 5 minutes and the peripheral velocity of the outermost end of the stirring member 3 was adjusted to provide a constant drive member 8 power of 0.9 W/g (drive member 8 rotation rate of 2750 rpm). After the completion of the first stage of external addition, strontium titanate fine particle 1 was added so as to provide 0.3 mass % with reference to the total mass of the magnetic toner and an external addition and mixing process was carried out. With regard to the conditions for the external addition and mixing process, the processing time was 1 minute and the peripheral velocity of the outermost end of the stirring member 3 was adjusted to provide a constant drive member 8 power of 0.9 W/g (drive member 8 rotation rate of 2750 rpm). The conditions for the external addition and mixing process are shown in Table 3.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average particle diameter of the primary particles of the silica fine particles on the magnetic toner surface was measured. The external addition conditions and properties of magnetic toner 1 are shown in Table 3 and Table 4, respectively.

Magnetic Toner Production Example 2

A magnetic toner 2 was obtained by following the same procedure as in Magnetic Toner Production Example 1, with the exception that magnetic toner particle 2 was in place of magnetic toner particle 1 in Magnetic Toner Production Example 1.

Magnetic Toner Production Example 3

A magnetic toner 3 was obtained by following the same procedure as in Magnetic Toner Production Example 2, with the exception that silica fine particles 2 were used in place of the silica fine particles 1. Silica fine particles 2 were obtained by performing the same surface treatment as with silica fine particles 1, but on a silica that had a BET specific area of 200 $m^2/g$ and a primary particle number-average particle diameter (D1) of 12 nm. A value of 14 nm was obtained when magnetic toner 3 was submitted to magnification and observation with a scanning electron microscope and the number-average particle diameter of the primary particles of the silica fine particles on the magnetic toner surface was measured. The external addition conditions and properties of magnetic toner 3 are shown in Table 3 and Table 4.

Magnetic Toner Production Example 4

A magnetic toner 4 was obtained by following the same procedure as in Magnetic Toner Production Example 2, with the exception that silica fine particle 3 was used in place of silica fine particle 1. Silica fine particle 3 was obtained by performing the same surface treatment as with silica fine particle 1, but on a silica that had a BET specific surface area of 90 $m^2/g$ and a primary particle number-average particle diameter (D1) of 25 nm. When the magnetic toner 4 was observed with a scanning electron microscope, a value of 28 nm was obtained when the number-average particle diameter of the primary particles of the silica fine particles on the magnetic toner surface was measured. The external addition conditions and properties of magnetic toner 4 are shown in Table 3 and Table 4.

Magnetic Toner Production Examples 5 to 9, 12 to 38 and 41 to 43 and Comparative Magnetic Toner Production Examples 1 to 25

Magnetic toners 5 to 9, 12 to 38, and 41 to 43 and comparative magnetic toners 1 to 25 were obtained using the strontium titanate fine particles shown in Table 3 in place of strontium titanate fine particle 1 in Magnetic Toner Production Example 1, using the magnetic toner particles shown in Table 3 in place of magnetic toner particle 1 in Magnetic Toner Production Example 1, and by performing the respective external addition processing using the external addition recipes, external addition apparatuses, and external addition conditions shown in Table 3. In the case of magnetic toners 5 to 9, 12 to 38, and 41 to 43 and comparative magnetic toners 1 to 12 and 16 and 17, the strontium titanate fine particles were introduced after external addition processing using the apparatus shown in FIG. 5 and processing was carried out for 1 minute at the external addition conditions given in Table 3. Otherwise, the strontium titanate fine particles were introduced at the same time as the silica fine particles. The properties of magnetic toners 5 to 9, 12 to 38, and 41 to 43 and comparative magnetic toners 1 to 25 are shown in Table 4.

Anatase titanium oxide fine particles (BET specific surface area: 80 $m^2/g$, primary particle number-average particle diameter (D1): 15 nm, treated with 12 mass % isobutyltrimethoxysilane) were used for the titania fine particles referenced in Table 3 and alumina fine particles (BET specific surface area: 80 $m^2/g$, primary particle number-average particle diameter (D1): 17 nm, treated with 10 mass % isobutyltrimethoxysilane) were used for the alumina fine particles referenced in Table 3.

In the case of magnetic toners 12 to 38 and comparative magnetic toners 1 to 12 and 16 and 17, pre-mixing with the Henschel mixer was not performed and the external addition and mixing process was executed immediately after introduction. The hybridizer referenced in Table 3 is the Hybridizer Model 5 (Nara Machinery Co., Ltd.), and the Henschel mixer referenced in Table 3 is the FM10C (Mitsui Miike Chemical Engineering Machinery Co., Ltd.).

Magnetic Toner Production Example 10

The external addition and mixing process was performed according to the following procedure using the same apparatus structure as the apparatus of FIG. 5, which is the same as in Magnetic Toner Production Example 1.

As shown in Table 3, the silica fine particle 1 (2.00 mass parts) added in Magnetic Toner Production Example 2 was changed to silica fine particle 1 (1.70 mass parts) and titania fine particles (0.30 mass parts).

First, 100 mass parts of magnetic toner particle 2, 0.70 mass parts of silica fine particle 1, and 0.30 mass parts of the titania fine particles were introduced and the same pre-mixing as in Magnetic Toner Production Example 2 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 0.9 W/g (drive member 8 rotation rate of 2750 rpm), after which the mixing process was temporarily stopped. The supplementary introduction of the remaining silica fine particles 1 (1.00 mass part with reference to 100 mass parts of magnetic toner particle) was then performed, followed by again processing for a processing time of 3 minutes while adjusting the peripheral velocity of the outermost end of the stirring member 3 so as to provide a constant drive member 8 power of 0.9 W/g (drive member 8 rotation rate of 2750 rpm), thus providing a total external addition and mixing process time of 5 minutes.

After the completion of the first stage of external addition, strontium titanate fine particle 1 was added at 0.3 mass % with reference to the total mass of the magnetic toner and an external addition and mixing process was carried out. With regard to the conditions for the external addition and mixing process, the processing time was 1 minute and the peripheral velocity of the outermost end of the stirring member 3 was adjusted to provide a constant drive member 8 power of 0.9 W/g (drive member 8 rotation rate of 2750 rpm). The external addition and mixing process conditions are given in Table 3.

After the external addition and mixing process, the coarse particles and so forth were removed using a circular vibrating screen as in Magnetic Toner Production Example 2 to obtain magnetic toner 10. The external addition conditions for magnetic toner 10 are given in Table 3 and the properties of magnetic toner 10 are given in Table 4.

Magnetic Toner Production Example 11

The external addition and mixing process was performed according to the following procedure using the same apparatus configuration as that of apparatus of FIG. 5 in Magnetic Toner Production Example 1.

As shown in Table 3, the silica fine particle 1 (2.00 mass parts) added in Magnetic Toner Production Example 2 was changed to silica fine particle 1 (1.70 mass parts) and titania fine particles (0.30 mass parts).

First, 100 mass parts of magnetic toner particle 2 and 1.70 mass parts of silica fine particle 1 were introduced and the same pre-mixing as in Magnetic Toner Production Example 2 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 0.9 W/g (drive member 8 rotation rate of 2750 rpm), after which the mixing process was temporarily stopped. The supplementary introduction of the remaining titania fine particles (0.30 mass parts with reference to 100 mass parts of magnetic toner particle) was then performed, followed by again processing for a processing time of 3 minutes while adjusting the peripheral velocity of the outermost end of the stirring member 3 so as to provide a constant drive member 8 power of 0.9 W/g (drive member 8 rotation rate of 2750 rpm), thus providing a total external addition and mixing process time of 5 minutes.

After the completion of the first stage of external addition, strontium titanate fine particle 1 was added at 0.3 mass % with reference to the total mass of the magnetic toner and an external addition and mixing process was carried out. With regard to the conditions for the external addition and mixing process, the processing time was 1 minute and the peripheral velocity of the outermost end of the stirring member 3 was adjusted to provide a constant drive member 8 power of 0.9 W/g (drive member 8 rotation rate of 2750 rpm). The external addition and mixing process conditions are given in Table 3.

After the external addition and mixing process, the coarse particles and so forth were removed using a circular vibrating screen as in Magnetic Toner Production Example 2 to obtain magnetic toner 11. The external addition conditions for magnetic toner 11 are given in Table 3 and the properties of magnetic toner 11 are given in Table 4.

Magnetic Toner Production Example 39

A magnetic toner 39 was obtained proceeding as in Magnetic Toner Production Example 2, with the exception that magnetic toner particle 8 was used in place of magnetic toner particle 2 and the addition of 2.00 mass parts of silica fine particle 1 to 100 mass parts (500 g) of the magnetic toner particles was changed to 1.80 mass parts. The external addition conditions for magnetic toner 39 are shown in Table 3 and the properties of magnetic toner 39 are shown in Table 4.

Magnetic Toner Production Example 40

A magnetic toner 40 was obtained proceeding as in Magnetic Toner Production Example 4, with the exception that magnetic toner particle 8 was used in place of magnetic toner particle 2 and the addition of 2.00 mass parts of silica fine particle 3 to 100 mass parts (500 g) of the magnetic toner particles was changed to 1.80 mass parts. The external addition conditions for magnetic toner 40 are shown in Table 3 and the properties of magnetic toner 40 are shown in Table 4.

Comparative Magnetic Toner Production Example 26

A comparative magnetic toner 26 was obtained by following the same procedure as in Magnetic Toner Production Example 2, with the exception that silica fine particles 4 were used in place of the silica fine particles 1. Silica fine particles 4 were obtained by performing the same surface treatment as with silica fine particles 1, but on a silica that had a BET specific area of 30 $m^2/g$ and a primary particle number-average particle diameter (D1) of 51 nm. A value of 53 nm was obtained when comparative magnetic toner 26 was submitted to magnification and observation with a scanning electron microscope and the number-average particle diameter of the primary particles of the silica fine particles on the magnetic toner surface was measured. The external addition conditions for magnetic toner 26 are shown in Table 3 and the properties of magnetic toner 26 are shown in Table 4.

TABLE 3

| | magnetic toner particle | silica fine particles (mass parts) | alumina fine particles (mass parts) | titania fine particles (mass parts) | strontium titanate fine particle | strontium titanate fine particles (mass %) | external addition apparatus | operating conditions for the external addition apparatus | operating time by the external addition apparatus |
|---|---|---|---|---|---|---|---|---|---|
| magnetic toner 1 | magnetic toner particle 1 | 2.00 | — | — | strontium titanate fine particle 1 | 0.3 | apparatus of FIG. 5 | 0.9 W/g | 5 min + 1 min |
| magnetic toner 2 | magnetic toner particle 2 | 2.00 | — | — | strontium titanate fine particle 1 | 0.3 | apparatus of FIG. 5 | 0.9 W/g | 5 min + 1 min |
| magnetic toner 3 | magnetic toner particle 2 | 2.00 | — | — | strontium titanate fine particle 1 | 0.3 | apparatus of FIG. 5 | 0.9 W/g | 5 min + 1 min |
| magnetic toner 4 | magnetic toner particle 2 | 2.00 | — | — | strontium titanate fine particle 1 | 0.3 | apparatus of FIG. 5 | 0.9 W/g | 5 min + 1 min |
| magnetic toner 5 | magnetic toner particle 3 | 2.00 | — | — | strontium titanate fine particle 1 | 0.3 | apparatus of FIG. 5 | 0.9 W/g | 5 min + 1 min |
| magnetic toner 6 | magnetic toner particle 4 | 2.00 | — | — | strontium titanate fine particle 1 | 0.3 | apparatus of FIG. 5 | 0.9 W/g | 5 min + 1 min |
| magnetic toner 7 | magnetic toner particle 2 | 1.80 | | 0.20 | strontium titanate fine particle 1 | 0.3 | apparatus of FIG. 5 | 0.9 W/g | 5 min + 1 min |
| magnetic toner 8 | magnetic toner particle 2 | 1.70 | — | 0.30 | strontium titanate fine particle 1 | 0.3 | apparatus of FIG. 5 | 0.9 W/g | 5 min + 1 min |
| magnetic toner 9 | magnetic toner particle 2 | 1.70 | 0.15 | 0.15 | strontium titanate fine particle 1 | 0.3 | apparatus of FIG. 5 | 0.9 W/g | 5 min + 1 min |
| magnetic toner 10 | magnetic toner particle 2 | 1.70 | — | 0.30 | strontium titanate fine particle 1 | 0.3 | apparatus of FIG. 5 | 0.9 W/g | 5 min + 1 min |
| magnetic toner 11 | magnetic toner particle 2 | 1.70 | — | 0.30 | strontium titanate fine particle 1 | 0.3 | apparatus of FIG. 5 | 0.9 W/g | 5 min + 1 min |
| magnetic toner 12 | magnetic toner particle 5 | 2.00 | — | — | strontium titanate fine particle 1 | 0.3 | apparatus of FIG. 5 | no pre-mixing 0.9 W/g | 5 min + 1 min |
| magnetic toner 13 | magnetic toner particle 5 | 2.00 | — | — | strontium titanate fine particle 1 | 0.3 | apparatus of FIG. 5 | no pre-mixing 0.9 W/g | 3 min + 1 min |
| magnetic toner 14 | magnetic toner particle 6 | 2.00 | — | — | strontium titanate fine particle 1 | 0.3 | apparatus of FIG. 5 | no pre-mixing 0.9 W/g | 3 min + 1 min |
| magnetic toner 15 | magnetic toner particle 6 | 2.00 | — | — | strontium titanate fine particle 1 | 1.0 | apparatus of FIG. 5 | no pre-mixing 0.9 W/g | 3 min + 1 min |
| magnetic toner 16 | magnetic toner particle 6 | 2.00 | — | — | strontium titanate fine particle 1 | 1.5 | apparatus of FIG. 5 | no pre-mixing 0.9 W/g | 3 min + 1 min |
| magnetic toner 17 | magnetic toner particle 6 | 2.00 | — | — | strontium titanate fine particle 1 | 2.0 | apparatus of FIG. 5 | no pre-mixing 0.9 W/g | 3 min + 1 min |
| magnetic toner 18 | magnetic toner particle 6 | 2.00 | — | — | strontium titanate fine particle 2 | 0.3 | apparatus of FIG. 5 | no pre-mixing 0.9 W/g | 3 min + 1 min |
| magnetic toner 19 | magnetic toner particle 6 | 2.00 | — | — | strontium titanate fine particle 3 | 0.3 | apparatus of FIG. 5 | no pre-mixing 0.9 W/g | 3 min + 1 min |
| magnetic toner 20 | magnetic toner particle 6 | 2.00 | — | — | strontium titanate fine particle 4 | 0.3 | apparatus of FIG. 5 | no pre-mixing 0.9 W/g | 3 min + 1 min |
| magnetic toner 21 | magnetic toner particle 6 | 2.00 | — | — | strontium titanate fine particle 5 | 0.3 | apparatus of FIG. 5 | no pre-mixing 0.9 W/g | 3 min + 1 min |
| magnetic toner 22 | magnetic toner particle 6 | 2.00 | — | — | strontium titanate fine particle 6 | 0.3 | apparatus of FIG. 5 | no pre-mixing 0.9 W/g | 3 min + 1 min |
| magnetic toner 23 | magnetic toner particle 6 | 2.00 | — | — | strontium titanate fine particle 7 | 0.3 | apparatus of FIG. 5 | no pre-mixing 0.9 W/g | 3 min + 1 min |
| magnetic toner 24 | magnetic toner particle 6 | 2.00 | — | — | strontium titanate fine particle 6 | 0.1 | apparatus of FIG. 5 | no pre-mixing 0.9 W/g | 3 min + 1 min |
| magnetic toner 25 | magnetic toner particle 6 | 2.00 | — | — | strontium titanate fine particle 7 | 0.1 | apparatus of FIG. 5 | no pre-mixing 0.9 W/g | 3 min + 1 min |
| magnetic toner 26 | magnetic toner particle 6 | 2.00 | — | — | strontium titanate fine particle 6 | 3.0 | apparatus of FIG. 5 | no pre-mixing 0.9 W/g | 3 min + 1 min |
| magnetic toner 27 | magnetic toner particle 6 | 2.00 | — | — | strontium titanate fine particle 7 | 3.0 | apparatus of FIG. 5 | no pre-mixing 0.9 W/g | 3 min + 1 min |
| magnetic toner 28 | magnetic toner particle 6 | 2.60 | — | — | strontium titanate fine particle 7 | 3.0 | apparatus of FIG. 5 | no pre-mixing 0.9 W/g | 3 min + 1 min |
| magnetic toner 29 | magnetic toner particle 6 | 2.25 | — | 0.35 | strontium titanate fine particle 7 | 3.0 | apparatus of FIG. 5 | no pre-mixing 0.9 W/g | 3 min + 1 min |
| magnetic toner 30 | magnetic toner particle 6 | 2.25 | 0.17 | 0.18 | strontium titanate fine particle 7 | 3.0 | apparatus of FIG. 5 | no pre-mixing 0.9 W/g | 3 min + 1 min |
| magnetic toner 31 | magnetic toner particle 6 | 1.50 | — | — | strontium titanate fine particle 7 | 3.0 | apparatus of FIG. 5 | no pre-mixing 0.9 W/g | 3 min + 1 min |
| magnetic toner 32 | magnetic toner particle 6 | 1.28 | — | 0.22 | strontium titanate fine particle 7 | 3.0 | apparatus of FIG. 5 | no pre-mixing 0.9 W/g | 3 min + 1 min |
| magnetic toner 33 | magnetic toner particle 6 | 1.28 | 0.10 | 0.12 | strontium titanate fine particle 7 | 3.0 | apparatus of FIG. 5 | no pre-mixing 0.9 W/g | 3 min + 1 min |
| magnetic toner 34 | magnetic toner particle 6 | 1.50 | — | — | strontium titanate fine particle 7 | 3.0 | apparatus of FIG. 5 | no pre-mixing 1.5 W/g | 3 min + 1 min |
| magnetic toner 35 | magnetic toner particle 6 | 1.50 | — | — | strontium titanate fine particle 7 | 3.0 | apparatus of FIG. 5 | no pre-mixing 0.6 W/g | 3 min + 1 min |
| magnetic toner 36 | magnetic toner particle 6 | 2.60 | — | — | strontium titanate fine particle 7 | 3.0 | apparatus of FIG. 5 | no pre-mixing 0.6 W/g | 3 min + 1 min |
| magnetic toner 37 | magnetic toner particle 6 | 2.60 | — | — | strontium titanate fine particle 7 | 3.0 | apparatus of FIG. 5 | no pre-mixing 1.5 W/g | 3 min + 1 min |
| magnetic toner 38 | magnetic toner particle 7 | 2.60 | — | — | strontium titanate fine particle 7 | 3.0 | apparatus of FIG. 5 | no pre-mixing 1.5 W/g | 3 min + 1 min |
| magnetic toner 39 | magnetic toner particle 8 | 1.80 | — | — | strontium titanate fine particle 7 | 3.0 | apparatus of FIG. 5 | 0.9 W/g | 5 min + 1 min |
| magnetic toner 40 | magnetic toner particle 8 | 1.80 | — | — | strontium titanate fine particle 7 | 3.0 | apparatus of FIG. 5 | 0.9 W/g | 5 min + 1 min |
| magnetic toner 41 | magnetic toner particle 8 | 2.00 | — | — | strontium titanate fine particle 9 | 0.3 | apparatus of FIG. 5 | 0.9 W/g | 5 min + 1 min |
| magnetic toner 42 | magnetic toner particle 9 | 2.00 | — | — | strontium titanate fine particle 1 | 0.3 | apparatus of FIG. 5 | 0.9 W/g | 5 min + 1 min |
| magnetic toner 43 | magnetic toner particle 10 | 2.00 | — | — | strontium titanate fine particle 1 | 0.3 | apparatus of FIG. 5 | 0.9 W/g | 5 min + 1 min |

TABLE 3-continued

| | magnetic toner particle | silica fine particles (mass parts) | alumina fine particles (mass parts) | titania fine particles (mass parts) | strontium titanate fine particle | strontium titanate fine particles (mass %) | external addition apparatus | operating conditions for the external addition apparatus | operating time by the external addition apparatus |
|---|---|---|---|---|---|---|---|---|---|
| comparative magnetic toner 1 | magnetic toner particle 6 | 1.60 | — | 0.40 | strontium titanate fine particle 7 | 3.0 | apparatus of FIG. 5 | no pre-mixing 0.9 W/g | 3 min + 1 min |
| comparative magnetic toner 2 | magnetic toner particle 6 | 1.60 | 0.20 | 0.20 | strontium titanate fine particle 7 | 3.0 | apparatus of FIG. 5 | no pre-mixing 0.9 W/g | 3 min + 1 min |
| comparative magnetic toner 3 | magnetic toner particle 6 | 1.20 | — | — | strontium titanate fine particle 7 | 3.0 | apparatus of FIG. 5 | no pre-mixing 0.6 W/g | 3 min + 1 min |
| comparative magnetic toner 4 | magnetic toner particle 6 | 1.60 | — | — | strontium titanate fine particle 7 | 3.0 | apparatus of FIG. 5 | no pre-mixing 0.6 W/g | 3 min + 1 min |
| comparative magnetic toner 5 | magnetic toner particle 6 | 1.20 | — | — | strontium titanate fine particle 7 | 3.0 | apparatus of FIG. 5 | no pre-mixing 1.6 W/g | 3 min + 1 min |
| comparative magnetic toner 6 | magnetic toner particle 6 | 1.60 | — | — | strontium titanate fine particle 7 | 3.0 | apparatus of FIG. 5 | no pre-mixing 2.2 W/g | 3 min + 1 min |
| comparative magnetic toner 7 | magnetic toner particle 6 | 3.10 | — | — | strontium titanate fine particle 7 | 3.0 | apparatus of FIG. 5 | no pre-mixing 1.6 W/g | 3 min + 1 min |
| comparative magnetic toner 8 | magnetic toner particle 6 | 2.60 | — | — | strontium titanate fine particle 7 | 3.0 | apparatus of FIG. 5 | no pre-mixing 0.6 W/g | 3 min + 1 min |
| comparative magnetic toner 9 | magnetic toner particle 6 | 3.00 | — | — | strontium titanate fine particle 7 | 3.0 | apparatus of FIG. 5 | no pre-mixing 2.2 W/g | 3 min + 1 min |
| comparative magnetic toner 10 | magnetic toner particle 6 | 2.60 | — | — | strontium titanate fine particle 7 | 3.0 | apparatus of FIG. 5 | no pre-mixing 2.2 W/g | 3 min + 1 min |
| comparative magnetic toner 11 | magnetic toner particle 11 | 2.00 | — | — | strontium titanate fine particle 1 | 3.0 | apparatus of FIG. 5 | no pre-mixing 0.9 W/g | 3 min + 1 min |
| comparative magnetic toner 12 | magnetic toner particle 6 | 2.00 | — | — | strontium titanate fine particle 8 | 0.1 | apparatus of FIG. 5 | no pre-mixing 0.9 W/g | 3 min + 1 min |
| comparative magnetic toner 13 | magnetic toner particle 8 | 2.60 | — | — | strontium titanate fine particle 8 | 0.3 | Henschel mixer | 3000 rpm | 2 min + 1 min |
| comparative magnetic toner 14 | magnetic toner particle 6 | 2.60 | — | — | strontium titanate fine particle 1 | 0.3 | Henschel mixer | 4000 rpm | 5 min + 1 min |
| comparative magnetic toner 15 | magnetic toner particle 6 | 1.50 | — | — | strontium titanate fine particle 1 | 0.3 | Henschel mixer | 4000 rpm | 5 min + 1 min |
| comparative magnetic toner 16 | magnetic toner particle 6 | 2.00 | — | — | strontium titanate fine particle 6 | 3.1 | apparatus of FIG. 5 | no pre-mixing 0.9 W/g | 3 min + 1 min |
| comparative magnetic toner 17 | magnetic toner particle 6 | 2.00 | — | — | strontium titanate fine particle 6 | 0.05 | apparatus of FIG. 5 | no pre-mixing 0.9 W/g | 3 min + 1 min |
| comparative magnetic toner 18 | magnetic toner particle 6 | 2.00 | — | — | strontium titanate fine particle 7 | 3.0 | hybridizer | 6000 rpm | 5 min + 1 min |
| comparative magnetic toner 19 | magnetic toner particle 12 | 2.00 | — | — | strontium titanate fine particle 7 | 3.0 | hybridizer | 6000 rpm | 5 min + 1 min |
| comparative magnetic toner 20 | magnetic toner particle 6 | 1.50 | — | — | strontium titanate fine particle 7 | 3.0 | hybridizer | 7000 rpm | 8 min + 1 min |
| comparative magnetic toner 21 | magnetic toner particle 6 | 1.50 | — | — | strontium titanate fine particle 7 | 3.0 | hybridizer | 7000 rpm | 8 min + 1 min |
| comparative magnetic toner 22 | magnetic toner particle 13 | 1.00 | — | — | strontium titanate fine particle 1 | 0.3 | Henschel mixer | 4000 rpm | 2 min + 1 min |
| comparative magnetic toner 23 | magnetic toner particle 13 | 2.00 | — | — | strontium titanate fine particle 1 | 0.3 | Henschel mixer | 4000 rpm | 2 min + 1 min |
| comparative magnetic toner 24 | magnetic toner particle 14 | 1.00 | — | — | strontium titanate fine particle 1 | 0.3 | Henschel mixer | 4000 rpm | 2 min + 1 min |
| comparative magnetic toner 25 | magnetic toner particle 14 | 2.00 | — | — | strontium titanate fine particle 1 | 0.3 | Henschel mixer | 4000 rpm | 2 min + 1 min |
| comparative magnetic toner 26 | magnetic toner particle 2 | 2.00 | — | — | strontium titanate fine particle 1 | 0.3 | apparatus of FIG. 5 | 0.9 W/g | 5 min + 1 min |

TABLE 4

| | magnetic toner particle | coverage ratio A (%) | B/A (—) | release rate for the strontium titanate fine particles (%) | D4/D1 (—) | σT/σS (—) | variation coefficient for coverage ratio A (%) | content of silica fine particles in the fixed fine particles (mass %) |
|---|---|---|---|---|---|---|---|---|
| magnetic toner 1 | magnetic toner particle 1 | 61.3 | 0.70 | 29 | 1.24 | 0.06 | 7.5 | 100 |
| magnetic toner 2 | magnetic toner particle 2 | 60.4 | 0.72 | 27 | 1.25 | 0.09 | 7.2 | 100 |
| magnetic toner 3 | magnetic toner particle 2 | 62.1 | 0.73 | 26 | 1.24 | 0.09 | 6.7 | 100 |
| magnetic toner 4 | magnetic toner particle 2 | 55.3 | 0.65 | 25 | 1.23 | 0.09 | 8.1 | 100 |
| magnetic toner 5 | magnetic toner particle 3 | 60.1 | 0.71 | 23 | 1.26 | 0.09 | 7.0 | 100 |
| magnetic toner 6 | magnetic toner particle 4 | 60.2 | 0.72 | 25 | 1.26 | 0.09 | 6.9 | 100 |
| magnetic toner 7 | magnetic toner particle 2 | 59.9 | 0.70 | 24 | 1.25 | 0.09 | 6.9 | 88 |
| magnetic toner 8 | magnetic toner particle 2 | 59.6 | 0.68 | 23 | 1.25 | 0.09 | 7.0 | 84 |
| magnetic toner 9 | magnetic toner particle 2 | 59.1 | 0.69 | 21 | 1.25 | 0.09 | 6.7 | 83 |
| magnetic toner 10 | magnetic toner particle 2 | 59.2 | 0.66 | 22 | 1.25 | 0.09 | 7.0 | 83 |
| magnetic toner 11 | magnetic toner particle 2 | 59.7 | 0.69 | 24 | 1.25 | 0.09 | 7.0 | 84 |
| magnetic toner 12 | magnetic toner particle 5 | 53.6 | 0.69 | 19 | 1.28 | 0.09 | 9.6 | 100 |
| magnetic toner 13 | magnetic toner particle 5 | 51.5 | 0.66 | 17 | 1.28 | 0.09 | 10.7 | 100 |
| magnetic toner 14 | magnetic toner particle 6 | 51.2 | 0.71 | 14 | 1.30 | 0.09 | 10.5 | 100 |
| magnetic toner 15 | magnetic toner particle 6 | 51.6 | 0.73 | 13 | 1.30 | 0.09 | 10.6 | 100 |
| magnetic toner 16 | magnetic toner particle 6 | 51.8 | 0.71 | 12 | 1.29 | 0.09 | 10.5 | 100 |
| magnetic toner 17 | magnetic toner particle 6 | 51.7 | 0.70 | 12 | 1.30 | 0.09 | 10.6 | 100 |
| magnetic toner 18 | magnetic toner particle 6 | 51.5 | 0.68 | 15 | 1.28 | 0.09 | 10.4 | 100 |
| magnetic toner 19 | magnetic toner particle 6 | 51.1 | 0.66 | 17 | 1.27 | 0.09 | 10.6 | 100 |
| magnetic toner 20 | magnetic toner particle 6 | 51.6 | 0.69 | 14 | 1.28 | 0.09 | 10.4 | 100 |
| magnetic toner 21 | magnetic toner particle 6 | 50.9 | 0.70 | 18 | 1.30 | 0.09 | 10.7 | 100 |
| magnetic toner 22 | magnetic toner particle 6 | 50.8 | 0.67 | 20 | 1.29 | 0.09 | 10.5 | 100 |
| magnetic toner 23 | magnetic toner particle 6 | 51.1 | 0.68 | 13 | 1.28 | 0.09 | 10.8 | 100 |
| magnetic toner 24 | magnetic toner particle 6 | 51.2 | 0.68 | 14 | 1.30 | 0.09 | 10.4 | 100 |
| magnetic toner 25 | magnetic toner particle 6 | 51.4 | 0.67 | 10 | 1.30 | 0.09 | 10.6 | 100 |
| magnetic toner 26 | magnetic toner particle 6 | 50.9 | 0.65 | 26 | 1.30 | 0.09 | 10.8 | 100 |
| magnetic toner 27 | magnetic toner particle 6 | 51.0 | 0.66 | 18 | 1.29 | 0.09 | 10.6 | 100 |
| magnetic toner 28 | magnetic toner particle 6 | 69.2 | 0.64 | 17 | 1.30 | 0.09 | 10.5 | 100 |
| magnetic toner 29 | magnetic toner particle 6 | 68.4 | 0.65 | 14 | 1.28 | 0.09 | 10.5 | 83 |
| magnetic toner 30 | magnetic toner particle 6 | 68.7 | 0.66 | 15 | 1.30 | 0.09 | 10.4 | 84 |
| magnetic toner 31 | magnetic toner particle 6 | 45.4 | 0.56 | 16 | 1.28 | 0.09 | 10.6 | 100 |
| magnetic toner 32 | magnetic toner particle 6 | 45.2 | 0.54 | 15 | 1.30 | 0.09 | 10.8 | 83 |
| magnetic toner 33 | magnetic toner particle 6 | 46.3 | 0.58 | 15 | 1.30 | 0.09 | 10.3 | 84 |
| magnetic toner 34 | magnetic toner particle 6 | 46.1 | 0.83 | 14 | 1.29 | 0.09 | 10.4 | 100 |
| magnetic toner 35 | magnetic toner particle 6 | 45.8 | 0.53 | 12 | 1.30 | 0.09 | 10.8 | 100 |
| magnetic toner 36 | magnetic toner particle 6 | 69.1 | 0.54 | 16 | 1.28 | 0.09 | 10.5 | 100 |
| magnetic toner 37 | magnetic toner particle 6 | 69.1 | 0.82 | 17 | 1.29 | 0.09 | 10.5 | 100 |
| magnetic toner 38 | magnetic toner particle 7 | 51.8 | 0.68 | 14 | 1.28 | 0.11 | 10.6 | 100 |
| magnetic toner 39 | magnetic toner particle 8 | 55.1 | 0.71 | 23 | 1.25 | 0.11 | 6.5 | 100 |
| magnetic toner 40 | magnetic toner particle 8 | 52.3 | 0.64 | 21 | 1.24 | 0.11 | 9.2 | 100 |
| magnetic toner 41 | magnetic toner particle 8 | 61.3 | 0.68 | 17 | 1.23 | 0.11 | 7.5 | 100 |
| magnetic toner 42 | magnetic toner particle 9 | 59.7 | 0.70 | 14 | 1.28 | 0.11 | 7.0 | 100 |
| magnetic toner 43 | magnetic toner particle 10 | 65.1 | 0.74 | 15 | 1.27 | 0.11 | 7.1 | 100 |
| comparative magnetic toner 1 | magnetic toner particle 6 | 48.9 | 0.52 | 14 | 1.30 | 0.09 | 10.6 | 78 |
| comparative magnetic toner 2 | magnetic toner particle 6 | 47.8 | 0.57 | 14 | 1.31 | 0.09 | 10.4 | 77 |
| comparative magnetic toner 3 | magnetic toner particle 6 | 42.6 | 0.53 | 12 | 1.33 | 0.09 | 10.1 | 100 |
| comparative magnetic toner 4 | magnetic toner particle 6 | 45.5 | 0.48 | 14 | 1.31 | 0.09 | 10.4 | 100 |
| comparative magnetic toner 5 | magnetic toner particle 6 | 42.8 | 0.85 | 11 | 1.32 | 0.09 | 10.2 | 100 |
| comparative magnetic toner 6 | magnetic toner particle 6 | 45.3 | 0.88 | 10 | 1.30 | 0.09 | 10.3 | 100 |
| comparative magnetic toner 7 | magnetic toner particle 6 | 73.1 | 0.53 | 14 | 1.31 | 0.09 | 10.1 | 100 |
| comparative magnetic toner 8 | magnetic toner particle 6 | 69.3 | 0.45 | 12 | 1.31 | 0.09 | 10.4 | 100 |
| comparative magnetic toner 9 | magnetic toner particle 6 | 71.1 | 0.81 | 13 | 1.32 | 0.09 | 10.3 | 100 |
| comparative magnetic toner 10 | magnetic toner particle 6 | 68.9 | 0.86 | 12 | 1.30 | 0.09 | 10.2 | 100 |
| comparative magnetic toner 11 | magnetic toner particle 11 | 49.6 | 0.68 | 15 | 1.35 | 0.09 | 11.6 | 100 |
| comparative magnetic toner 12 | magnetic toner particle 6 | 50.6 | 0.65 | 18 | 1.30 | 0.09 | 11.7 | 100 |
| comparative magnetic toner 13 | magnetic toner particle 8 | 46.8 | 0.36 | 21 | 1.32 | 0.09 | 13.4 | 100 |
| comparative magnetic toner 14 | magnetic toner particle 6 | 48.2 | 0.35 | 7 | 1.31 | 0.09 | 13.2 | 100 |
| comparative magnetic toner 15 | magnetic toner particle 6 | 37.5 | 0.41 | 5 | 1.30 | 0.09 | 18.1 | 100 |
| comparative magnetic toner 16 | magnetic toner particle 6 | 50.5 | 0.61 | 35 | 1.33 | 0.09 | 11.5 | 100 |
| comparative magnetic toner 17 | magnetic toner particle 6 | 50.9 | 0.64 | 11 | 1.30 | 0.09 | 11.4 | 100 |
| comparative magnetic toner 18 | magnetic toner particle 6 | 54.1 | 0.53 | 7 | 1.31 | 0.09 | 12.4 | 100 |
| comparative magnetic toner 19 | magnetic toner particle 12 | 54.3 | 0.51 | 9 | 1.33 | 0.09 | 12.2 | 100 |
| comparative magnetic toner 20 | magnetic toner particle 6 | 43.7 | 0.81 | 12 | 1.30 | 0.09 | 13.6 | 100 |
| comparative magnetic toner 21 | magnetic toner particle 6 | 44.6 | 0.87 | 10 | 1.30 | 0.09 | 13.8 | 100 |
| comparative magnetic toner 22 | magnetic toner particle 13 | 41.8 | 0.48 | 3 | 1.30 | 0.09 | 14.9 | 100 |
| comparative magnetic toner 23 | magnetic toner particle 13 | 54.3 | 0.46 | 5 | 1.31 | 0.09 | 15.3 | 100 |
| comparative magnetic toner 24 | magnetic toner particle 14 | 63.7 | 0.86 | 6 | 1.30 | 0.09 | 13.5 | 100 |
| comparative magnetic toner 25 | magnetic toner particle 14 | 71.8 | 0.84 | 8 | 1.31 | 0.09 | 13.2 | 100 |
| comparative magnetic toner 26 | magnetic toner particle 2 | 36.2 | 0.51 | 9 | 1.25 | 0.09 | 14.1 | 100 |

Example 1

The Image-Forming Apparatus

The image-forming apparatus was an LBP-3100 (Canon, Inc.), which was equipped with a small-diameter developing sleeve that had a diameter of 10 mm; its printing speed had been modified from 16 sheets/minute to 20 sheets/minute. In an image-forming apparatus equipped with a small-diameter developing sleeve, the durability can be rigorously evaluated by changing the printing speed to 20 sheets/minute.

Using this modified apparatus and magnetic toner 1, an image check was performed under a normal-temperature, normal-humidity environment (under an NN environment, 23° C./50% RH), followed by standing for 30 days under a severe environment (40° C./95% RH) and then a 50-sheet image output test in one-sheet intermittent mode of a solid image.

According to the results, an excellent image, which had little fogging in nonimage areas and in which density reduction was suppressed, could be obtained even immediately after standing in a severe environment. The results of the evaluation are shown in Table 5.

The evaluation methods and associated scales used in the evaluations carried out in the examples of the present invention and comparative examples are described below.

<Image Density>

For the image density, a solid image area was formed and the density of this solid image was measured with a MacBeth reflection densitometer (MacBeth Corporation). The following scale was used to score the average reflection density of the solid image on the 50 prints up to the initial 50th print after standing in a severe environment (also referred to as after severe storage) (evaluation 1).

A: very good (greater than or equal to 1.45)
B: good (less than 1.45 and greater than or equal to 1.40)
C: average (less than 1.40 and greater than or equal to 1.30)
D: poor (less than 1.30)

The following scale was used to score the image density before and after severe storage (evaluation 2).

A better result is indicated by a smaller difference between the reflection density of the solid image prior to severe storage and the reflection density of the solid image after severe storage.

A: very good (less than 0.05)
B: good (less than 0.10 and greater than or equal to 0.05)
C: average (less than 0.15 and greater than or equal to 0.10)
D: poor (greater than or equal to 0.15)

<Fogging after Severe Storage (Evaluation 3)>

A white image was output after severe storage and its reflectance was measured using a REFLECTMETER MODEL TC-6DS from Tokyo Denshoku Co., Ltd. On the other hand, the reflectance was also similarly measured on the transfer paper (standard paper) prior to formation of the white image. A green filter was used as the filter. The fogging was calculated using the following formula from the reflectance before output of the white image and the reflectance after output of the white image.

fogging (reflectance) (%)=reflectance (%) of the standard paper−reflectance (%) of the white image sample The scale for scoring the fogging is below.

A: very good (less than 1.2%)
B: good (less than 2.0% and greater than or equal to 1.2%)
C: average (less than 3.0% and greater than or equal to 2.0%)
D: poor (greater than or equal to 3.0%)

Examples 2 to 42 and Comparative Examples 1 to 26

Toner evaluations were carried out under the same conditions as in Example 1 using magnetic toners 2 to 42 and comparative magnetic toners 1 to 26 for the magnetic toner. The results of the evaluations are shown in Table 5. With comparative magnetic toner 7, there was a very substantial amount of released silica fine particles on the developing sleeve and image defects in the form of vertical streaks were produced.

TABLE 5

| | | evaluation 1 (starting density after severe storage) | evaluation 2 (extent of density reduction after severe storage) | evaluation 3 (fogging after severe storage) |
|---|---|---|---|---|
| Example 1 | magnetic toner 1 | A(1.50) | A(0.02) | A(0.3) |
| Example 2 | magnetic toner 2 | A(1.48) | A(0.03) | A(0.5) |
| Example 3 | magnetic toner 3 | A(1.47) | A(0.03) | A(0.5) |
| Example 4 | magnetic toner 4 | A(1.47) | A(0.04) | A(0.7) |
| Example 5 | magnetic toner 5 | A(1.46) | A(0.04) | A(0.7) |
| Example 6 | magnetic toner 6 | A(1.47) | A(0.04) | A(0.6) |
| Example 7 | magnetic toner 7 | A(1.47) | A(0.04) | A(0.6) |
| Example 8 | magnetic toner 8 | A(1.46) | A(0.04) | A(0.7) |
| Example 9 | magnetic toner 9 | A(1.46) | A(0.04) | A(0.7) |
| Example 10 | magnetic toner 10 | A(1.45) | A(0.04) | A(0.8) |
| Example 11 | magnetic toner 11 | A(1.45) | A(0.04) | A(0.7) |
| Example 12 | magnetic toner 12 | A(1.45) | A(0.04) | A(0.7) |
| Example 13 | magnetic toner 13 | B(1.41) | B(0.08) | A(0.8) |
| Example 14 | magnetic toner 14 | C(1.39) | B(0.09) | A(0.8) |
| Example 15 | magnetic toner 15 | C(1.38) | B(0.09) | A(0.7) |
| Example 16 | magnetic toner 16 | C(1.36) | B(0.09) | A(0.8) |
| Example 17 | magnetic toner 17 | C(1.35) | B(0.08) | A(0.9) |
| Example 18 | magnetic toner 18 | C(1.38) | B(0.09) | A(0.9) |
| Example 19 | magnetic toner 19 | C(1.37) | B(0.09) | A(0.9) |
| Example 20 | magnetic toner 20 | C(1.37) | B(0.09) | A(1.0) |
| Example 21 | magnetic toner 21 | C(1.36) | B(0.09) | B(1.2) |
| Example 22 | magnetic toner 22 | C(1.36) | B(0.09) | B(1.5) |
| Example 23 | magnetic toner 23 | C(1.36) | B(0.09) | B(1.3) |
| Example 24 | magnetic toner 24 | C(1.36) | B(0.08) | B(1.7) |

TABLE 5-continued

| | | evaluation 1 (starting density after severe storage) | evaluation 2 (extent of density reduction after severe storage) | evaluation 3 (fogging after severe storage) |
|---|---|---|---|---|
| Example 25 | magnetic toner 25 | C(1.35) | B(0.09) | A(0.9) |
| Example 26 | magnetic toner 26 | C(1.39) | B(0.08) | B(1.4) |
| Example 27 | magnetic toner 27 | C(1.37) | B(0.06) | B(1.1) |
| Example 28 | magnetic toner 28 | C(1.38) | C(0.12) | B(1.4) |
| Example 29 | magnetic toner 29 | C(1.37) | C(0.14) | B(1.5) |
| Example 30 | magnetic toner 30 | C(1.36) | C(0.14) | B(1.5) |
| Example 31 | magnetic toner 31 | C(1.38) | C(0.11) | B(1.3) |
| Example 32 | magnetic toner 32 | C(1.37) | C(0.13) | B(1.4) |
| Example 33 | magnetic toner 33 | C(1.36) | C(0.14) | B(1.5) |
| Example 34 | magnetic toner 34 | C(1.36) | C(0.13) | B(1.6) |
| Example 35 | magnetic toner 35 | C(1.35) | C(0.12) | B(1.7) |
| Example 36 | magnetic toner 36 | C(1.35) | C(0.12) | B(1.6) |
| Example 37 | magnetic toner 37 | C(1.37) | C(0.13) | B(1.5) |
| Example 38 | magnetic toner 38 | C(1.31) | B(0.09) | A(0.8) |
| Example 39 | magnetic toner 39 | C(1.35) | B(0.05) | A(0.7) |
| Example 40 | magnetic toner 40 | C(1.34) | B(0.05) | A(0.9) |
| Example 41 | magnetic toner 41 | C(1.33) | B(0.05) | A(0.5) |
| Example 42 | magnetic toner 42 | C(1.32) | B(0.07) | A(1.0) |
| Example 43 | magnetic toner 43 | C(1.33) | B(0.09) | A(0.5) |
| Comparative Example 1 | comparative magnetic toner 1 | C(1.34) | C(0.14) | C(2.2) |
| Comparative Example 2 | comparative magnetic toner 2 | C(1.34) | C(0.13) | C(2.1) |
| Comparative Example 3 | comparative magnetic toner 3 | C(1.31) | D(0.15) | B(1.5) |
| Comparative Example 4 | comparative magnetic toner 4 | C(1.32) | D(0.16) | B(1.6) |
| Comparative Example 5 | comparative magnetic toner 5 | C(1.32) | D(0.16) | B(1.5) |
| Comparative Example 6 | comparative magnetic toner 6 | C(1.31) | D(0.18) | B(1.6) |
| Comparative Example 7 | comparative magnetic toner 7 | C(1.34) | C(0.12) | C(2.3) |
| Comparative Example 8 | comparative magnetic toner 8 | C(1.32) | C(0.13) | C(2.1) |
| Comparative Example 9 | comparative magnetic toner 9 | D(1.29) | D(0.19) | B(1.6) |
| Comparative Example 10 | comparative magnetic toner 10 | D(1.28) | D(0.18) | B(1.4) |
| Comparative Example 11 | comparative magnetic toner 11 | D(1.25) | D(0.16) | B(1.4) |
| Comparative Example 12 | comparative magnetic toner 12 | D(1.12) | D(0.34) | A(0.7) |
| Comparative Example 13 | comparative magnetic toner 13 | D(1.10) | D(0.19) | A(0.8) |
| Comparative Example 14 | comparative magnetic toner 14 | D(1.08) | D(0.27) | A(0.6) |
| Comparative Example 15 | comparative magnetic toner 15 | D(1.10) | D(0.29) | A(0.6) |
| Comparative Example 16 | comparative magnetic toner 16 | D(1.06) | D(0.38) | A(0.7) |
| Comparative Example 17 | comparative magnetic toner 17 | D(1.12) | D(0.32) | A(1.0) |
| Comparative Example 18 | comparative magnetic toner 18 | D(128) | C(0.12) | C(2.4) |
| Comparative Example 19 | comparative magnetic toner 19 | C(1.31) | C(0.13) | C(2.2) |
| Comparative Example 20 | comparative magnetic toner 20 | C(1.34) | C(0.10) | C(2.1) |
| Comparative Example 21 | comparative magnetic toner 21 | C(1.31) | C(0.14) | C(2.2) |
| Comparative Example 22 | comparative magnetic toner 22 | D(1.11) | D(0.31) | A(0.8) |
| Comparative Example 23 | comparative magnetic toner 23 | D(1.13) | D(0.29) | A(0.7) |
| Comparative Example 24 | comparative magnetic toner 24 | D(1.13) | D(0.32) | A(0.6) |
| Comparative Example 25 | comparative magnetic toner 25 | D(1.11) | D(0.28) | A(0.8) |
| Comparative Example 26 | comparative magnetic toner 26 | C(1.30) | D(0.15) | B(1.5) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-019517, filed Feb. 1, 2012, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member (developing sleeve)
103: developing blade
114: transfer member (transfer roller)
116: cleaner
117: charging member (charging roller)
121: laser generator (latent image-forming means, photo-exposure apparatus)
123: laser
124: register roller
125: transport belt
126: fixing unit
140: developing device
141: stirring member

The invention claimed is:

1. A magnetic toner comprising:

magnetic toner particles comprising a binder resin and a magnetic body; and inorganic fine particles present on the surface of the magnetic toner particles, wherein the inorganic fine particles present on the surface of the magnetic toner particles comprise strontium titanate fine particles and metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85, the content of the strontium titanate fine particles, expressed with reference to the total amount of the magnetic toner, is from at least 0.1 mass % to not more than 3.0 mass %, the number-average particle diameter (D1) of the strontium titanate fine particles is from at least 60 nm to not more than 300 nm, in a magnetic separation test during the application of a negative voltage, the release rate for the strontium titanate fine particles is at least 10%, and the ratio [D4/D1] of the weight-average particle diameter (D4) to the number-average particle diameter (D1) for the magnetic toner is not more than 1.30.

2. The magnetic toner according to claim 1, wherein, in a magnetic field of 79.6 kA/m, the magnetic toner has a ratio [$\sigma/\sigma s$] of the residual magnetization ($\sigma r$) to the intensity of magnetization ($\sigma s$) of not more than 0.09.

3. The magnetic toner according to claim 1, wherein the coefficient of variation on the coverage ratio A is not more than 10.0%.

4. The magnetic toner according to claim 1, wherein the average surface roughness (Ra) of the magnetic toner particles as measured by a scanning probe microscope is from at least 30.0 nm to not more than 70.0 nm.

* * * * *